US006896615B2

(12) United States Patent
Berman

(10) Patent No.: US 6,896,615 B2
(45) Date of Patent: May 24, 2005

(54) GAMING METHOD AND APPARATUS IMPLEMENTING A HIERARCHICAL DISPLAY GRID AND DYNAMICALLY GENERATED PAYLINES

(75) Inventor: Bradley Berman, Edina, MN (US)

(73) Assignee: King Show Games, LLC, Minnetonka, MN (US)

( * ) Notice: Subject to any disclaimer, the term of this patent is extended or adjusted under 35 U.S.C. 154(b) by 311 days.

(21) Appl. No.: 09/947,619

(22) Filed: Sep. 6, 2001

(65) Prior Publication Data

US 2003/0045345 A1 Mar. 6, 2003

(51) Int. Cl.[7] ..... A63F 9/24
(52) U.S. Cl. ..... 463/20; 273/143 R
(58) Field of Search ..... 463/12–13, 16–22, 463/25, 30–32, 37, 43–44; 273/143 R

(56) References Cited

U.S. PATENT DOCUMENTS 5,611,535 A 3/1997 Tiberio
5,890,962 A * 4/1999 Takemoto ..... 463/20
6,004,208 A 12/1999 Takemoto et al.
6,093,102 A 7/2000 Bennett
6,123,333 A 9/2000 McGinnis, Sr. et al.
6,200,217 B1 3/2001 Osawa
6,227,971 B1 5/2001 Weiss
6,241,607 B1 6/2001 Payne et al.
6,261,178 B1 7/2001 Bennett
6,398,218 B1 6/2002 Vancura

* cited by examiner

*Primary Examiner*—Kim Nguyen

(57) ABSTRACT

A method and apparatus for use in gaming activities such as slot machines. A display grid having a multiple display segments is presented, where one or more of the display segments is presented having multiple display subsegments. Each of the display subsegments presents a subsegment symbol independently of the other display subsegments in its respective display segment. Paylines are created from a plurality of the display segments, where each of the subsegment symbols of each of the display subsegments is independently used in formulating payout results for each of the paylines in which the display segment is affiliated. Paylines may be dynamically created at any location as a result of corresponding symbols occurring in a predetermined number of adjacent display segments and/or subsegments.

61 Claims, 17 Drawing Sheets

FIG. *14*

GAMING METHOD AND APPARATUS IMPLEMENTING A HIERARCHICAL DISPLAY GRID AND DYNAMICALLY GENERATED PAYLINES

FIELD OF THE INVENTION

This invention relates in general to gaming systems and processes, and more particularly to a gaming method and apparatus implementing a hierarchical display grid utilizing multiple-symbol display segments, and for dynamically generating paylines within the display grid.

BACKGROUND OF THE INVENTION

Gaming devices such as slot machines have entertained the public for over a century. While the fundamental concept behind slot games has remained relatively intact, the manners of computing, displaying, and participating in modern day slot games has changed dramatically. One force driving these changes is technological advancement, such as the advent of computers and video capabilities. Another driving force is human nature, as the participants of such gaming devices demand continual excitement and stimulation. It is therefore important in the gaming industry that gaming innovations continue to be rolled out to the participating public.

Some gaming devices, such as slot machines, base the result of a gaming activity on a "payline." For example, in the context of slot machines, one, two, or more predefined paylines may be used. These paylines are generally predetermined lines or patterns encompassing a number of display segments on a mechanical or video display grid. If a predetermined symbol combination is presented on the display segments of any of the predetermined paylines, a winning payout result occurs.

Various manners of providing interesting paylines have been devised. The earliest slot machines included one payline, generally including one symbol location from each of three mechanical reels. Later slot machines provided two and three paylines by displaying symbols above and/or below the symbol locations associated with the first payline. This type of slot machine provided, for example, three horizontal paylines. As video technologies started entering the gaming industry, even more types of predetermined paylines were utilized. For example, paylines have been provided in horizontal, diagonal, and vertical arrangements, as well as some predetermined pattern such as V-shaped, zigzag shaped, etc.

However, each of these types of paylines is determined in advance. For example, a line or shape may be superimposed on the display segments to identify to the participant where a predetermined symbol combination must fall in order to provide a winning payout. Therefore, the paylines are in effect "fixed" for that particular slot machine, although there may be multiple paylines. This may in some cases detract from the suspense afforded through such a chance-based gaming device. One prior art slot machine addresses this through what is commonly referred to as a "scatter pay." A scatter pay is a random payline when a certain symbol is presented a fixed number of times on the display grid. However, scatter pays are entirely random on the display grid, and afford no correlation whatsoever to a physical payline on the display grid.

Further, these conventional slot machines utilize one display segment per payline position. A horizontal payline on a five column, three row display grid will include one symbol for each of the display segments associated with that payline. This can also detract from a participant's long-term interest in the particular slot machine.

The present invention addresses the aforementioned shortcomings of prior art gaming activities. The present invention provides gaming participants with a visually-appealing and exciting gaming activity, and provides additional advantages over prior art gaming activities.

SUMMARY OF THE INVENTION

To overcome limitations in the prior art described above, and to overcome other limitations that will become apparent upon reading and understanding the present specification, the present invention discloses an apparatus and method for providing multi-symbol display segments to allow multiple payout opportunities for each payline. The present invention also provides for the dynamic creation of paylines from adjacent symbols at each of the display segments and/or subsegments.

In accordance with one embodiment of the invention, a method for facilitating participation in a slot game is provided. A display grid comprising a plurality of display segments is presented. A plurality of display subsegments is presented in one or more of the display segments. Each of the display subsegments presents a subsegment symbol independently of the other display subsegments in its respective display segment. Paylines are created from a plurality of the display segments, where each of the subsegment symbols of each of the display subsegments is independently used in formulating payout results for each of the paylines in which the display segment is affiliated. In this manner, a particular payline comprised of a certain number of display segments may in actuality include a number of overlayed paylines due to the multiple symbols associated with some of the display segments. Other embodiments include dynamically creating the paylines as a result of corresponding symbols occurring in a predetermined number of adjacent display segments and/or subsegments.

In accordance with another aspect of the invention, a method is provided for facilitating participation in a slot game, where a display grid having a plurality of display segments is presented. Winning slot game paylines formulated from matching symbols occurring in a predetermined number of adjacent display segments and/or subsegments are dynamically created. In this manner, at least some of the paylines are not in predefined locations on the display grid, but rather are generated as a result of a predetermined number of symbols occurring in adjacent display segments/subsegments, regardless of where on the display grid these adjacent segments/subsegments present themselves.

In accordance with another embodiment of the invention, a casino gaming apparatus hosting a gaming activity is provided. The gaming apparatus includes a display device to present a display grid having a plurality of display segments. The display device also presents multiple display subsegments in at least one of the display segments. A random number generator randomly selects symbols for presentation in the display segments and display subsegments of the display grid. A processor identifies winning symbol combinations presented on display segment paylines of the display grid. The winning symbol combinations include corresponding symbols in each of the display segments of the display segment paylines. Each of the symbols presented in the display subsegments of a particular display segment is independently considered in identifying the winning symbol combinations occurring on the display segment paylines encompassing that display segment. In other embodiments, the processor is further configured to identify winning symbol combinations presented on dynamically-generated paylines, where the dynamically-generated paylines are identified by determining an occurrence of a predetermined number of adjacent display segments presenting the corresponding symbols.

In accordance with another embodiment of the invention, a slot machine is provided which includes a display to present a display grid having a plurality of display segments. A random number generator randomly select symbols for presentation in the display segments. A processor identifies at least one dynamically-generated winning symbol combination by recognizing a predetermined minimum number of adjacent display segments that present matching symbols.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

The invention is described in connection with the embodiments illustrated in the following diagrams.

FIG. 16, including

DETAILED DESCRIPTION OF THE ILLUSTRATED EMBODIMENTS

In the following description of the invention, reference is made to the accompanying drawings which form a part hereof, and in which is shown by way of illustration the specific embodiment in which the invention may be practiced. It is to be understood that other embodiments may be utilized, as structural and operational changes may be made without departing from the scope of the present invention.

Generally, the present invention is directed to a method and apparatus for providing multi-symbol display segments to allow multiple payout opportunities for each payline. The invention also includes features relating to the dynamic creation of paylines from adjacent symbols at each of the display subsegments.

The present invention, as described more fully below, is applicable to various gaming activities that are played on a gaming machine, including slot games such as reel slots and video slots, and other games utilizing a string of symbols to generate a game result. The present invention is described in terms of slot machines to provide an understanding of the invention. While the invention is particularly advantageous in the context of slot machines, and while a description in terms of slot machines facilitates an understanding of the invention, the invention is also applicable to other gaming activities of chance utilizing symbol strings as will be readily apparent to those of skill in the art from the description provided herein.

As is described more fully below, the present invention provides multi-symbol display segments to allow multiple payout opportunities for each payline. However, the invention is equally applicable in connection with secondary modes, such as bonus modes of play. As is known in the art, bonus events are used in gaming activities such as slot games, which provides an alternative mode of play that is intended to attract and captivate players of such slot games. Generally, a bonus game or event on a slot machine is typically an additional gaming reel or machine, or a random selection device, that is enabled by a bonus qualifying signal from an underlying or primary gaming activity. Generally, a predetermined prize-winning combination of symbols in an underlying or primary slot game may result in the player being awarded one or more bonus games. Often the bonus event has a much higher probability of winning, thereby instilling a great interest by players in being awarded bonus events. There are various secondary or "bonus" events known in the art. Thus, while an exemplary embodiment of the present invention is described in connection with a standard or primary mode of play, the present invention is equally applicable in secondary or bonus modes of play.

Figure 1:
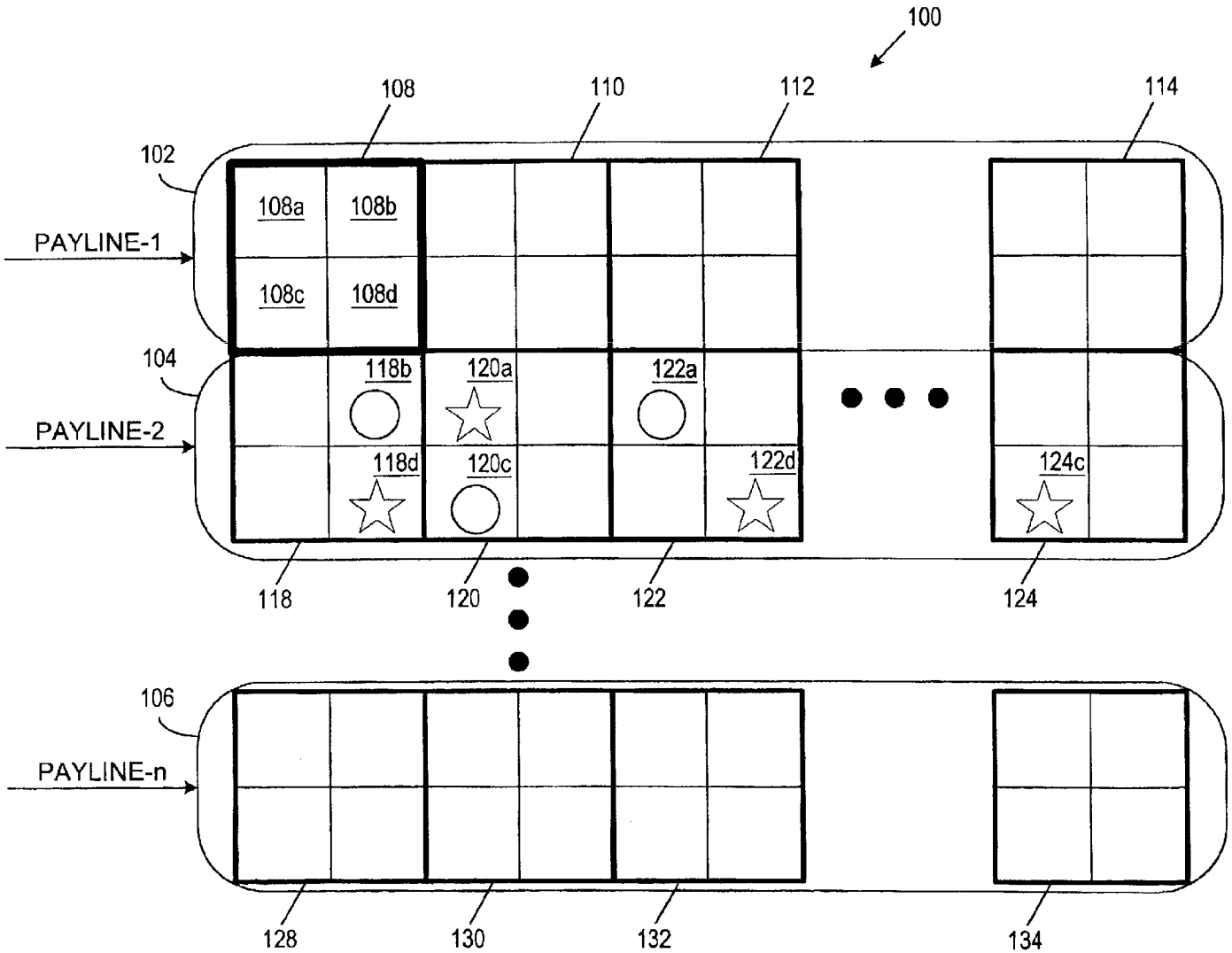
FIG. 1 is a block diagram illustrating one embodiment of a gaming activity utilizing multi-symbol display segments in accordance with the invention.

FIG. 1 is a block diagram illustrating one embodiment of a gaming activity utilizing multi-symbol display segments in accordance with the invention. The gaming activity is displayed to a gaming participant as a slot game grid 100 in this illustrated embodiment. Different slot games may exhibit a variety of different reel characteristics and display formats. For example, some slot games include a conventional three-reel configuration traditionally used in mechanical-reel slot machines. In a three-reel configuration, three reels each having an associated reel strip of symbols rotate vertically as viewed by the participant. The reels stop at random locations, thereby presenting the participant with one, two, or three paylines of potentially winning symbol combinations, depending on the amount wagered by the participant. In more recent times, this traditional reel display format has changed significantly, largely due to the ability to present electronic reels on a display screen. This has resulted in a variety of different reel formats, including greater quantities of vertically rotating electronic reels, greater numbers of paylines, and paylines that are vertical, diagonal, as well as the traditional horizontal paylines. The present invention is applicable with any reel configuration, including video, mechanical, LCD display, etc. Therefore, the slot game grid 100 of FIG. 1 is shown as having an indeterminate number of rows and columns, which can accordingly represent an indeterminate number of reels, paylines, and the like.

The slot game grid 100 of FIG. 1 includes a number of rows, which may correspond to different horizontal paylines. For example, a first row 102 corresponds to horizontal payline-1, row 104 corresponds to horizontal payline-2. Further desired rows are represented by the nth row illustrated as row 106 which corresponds to horizontal payline-n. Each row includes one or more display segments or cells. For example, the first row 102 includes display segments 108, 110, 112, through some predetermined number of display segments represented by display segment 114. Similarly, a second row includes display segments 118, 120, 122, through 124. Depending on the number of display segments, rows, paylines, etc. that are desired, additional rows through the final row are provided, where the final row 106 includes display segments 128, 130, 132, through 134. Thus, FIG. 1 represents a generic slot game grid having any number or combination of display segments.

In accordance with the present invention, each display segment, such as display segment 108 in row 102, includes a plurality of display subsegments. The number of subsegments may be any desired number, including one for some display segments. In the illustrated embodiment of FIG. 1, each display segment includes four display subsegments. For example, display segment 108 includes display subsegments 108*a*, 108*b*, 108*c*, and 108*d*. Each display subsegment may present a symbol in connection with the gaming activity. For example, after slot game "reels" are spun, symbols associated with predetermined reel strips are presented in each of the display subsegments 108*a*, 108*b*, 108*c*, 108*d*. This holds true for each of the display segments associated with the slot game grid 100. The symbols may be any predetermined symbols, including a null symbol which appears to the participant as a "blank" symbol.

Four display subsegments are provided for each of the display segments in the illustrated slot game grid 100, but as will become apparent to those skilled in the art, any number of display subsegments may be used in connection with each display segment. For example, each display segment (e.g., 108, 110, 112, etc.) may have two, three, four, five, etc. display subsegments associated therewith. In accordance with another embodiment of the invention, the display segments do not necessarily need to have the same number of display subsegments. For example, display segment 108 may have four display subsegments, while display segment 110 may have only one display subsegment and display segment 118 may have six or eight display subsegments. The principles of the present invention apply regardless of the particular number of display subsegments employed.

A slot game according to the invention provides an effective increase in the number of paylines by allowing overlapping paylines due to the increased number of symbols associated with each display segment. For example, each of the resulting symbols displayed in the display subsegments 108*a*, 108*b*, 108*c*, 108*d* of display segment 108 may be used in formulating a result for payline-1. In a more particular example, the symbol presented in display subsegment 108*a* is effectively considered "the" symbol associated with display segment 108 in determining a first potential winning result. If display subsegment 108*a* displays a cherry symbol, then each of the display subsegments associated with display segment 110 is analyzed to determine whether a cherry symbol is associated with any of display segment's 110 subsegments. Subsequent display segments along the payline are analogously analyzed to determine whether a predetermined number of successive display segments include a cherry symbol. For example, a payout may be awarded for three cherry symbols when occurring in three successive display segments, regardless of which of the particular display subsegments that the cherry symbols are presented. A more particular example is provided below in connection with payline-2.

Payline-2 includes some number of display segments, shown as display segments 118, 120, 122, 124. For purposes of this example, assume that these are the only four display segments in this particular row (i.e., the slot game grid 100 is a four-column grid). A payout schedule may identify that four star symbols is a winning symbol combination providing a payout. The random or pseudo-random presentation of star symbols in display subsegments 118*d*, 120*a*, 122*d*, and 124*c* would achieve that winning symbol combination. This is because the display segments 118, 120, 122, 124 are the actual locations in which the star symbol must appear in order to achieve the four-star winning combination, and each display segment 118, 120, 122, 124 includes a star symbol in respective display subsegments 118*d*, 120*a*, 122*d*, and 124*c*.

Payline-2 therefore has a winning combination of four stars resulting in a payout to the gaming participant. However, the gaming participant can obtain even more winning symbol combinations on the same payline-2. For example, assume that the payout schedule further identifies that three consecutive circle symbols results in a winning symbol combination providing a payout. The random or pseudo-random presentation of circle symbols in display subsegments 118*b*, 120*c*, and 122*a* would achieve that winning symbol combination. This is because the display segments 118, 120, 122 are the actual locations in which the circle symbol must appear in order to achieve the three-circle winning combination, and each display segment 118, 120, 122 includes a circle symbol in respective display subsegments 118*b*, 120*c*, and 122*a*.

Figure 2:
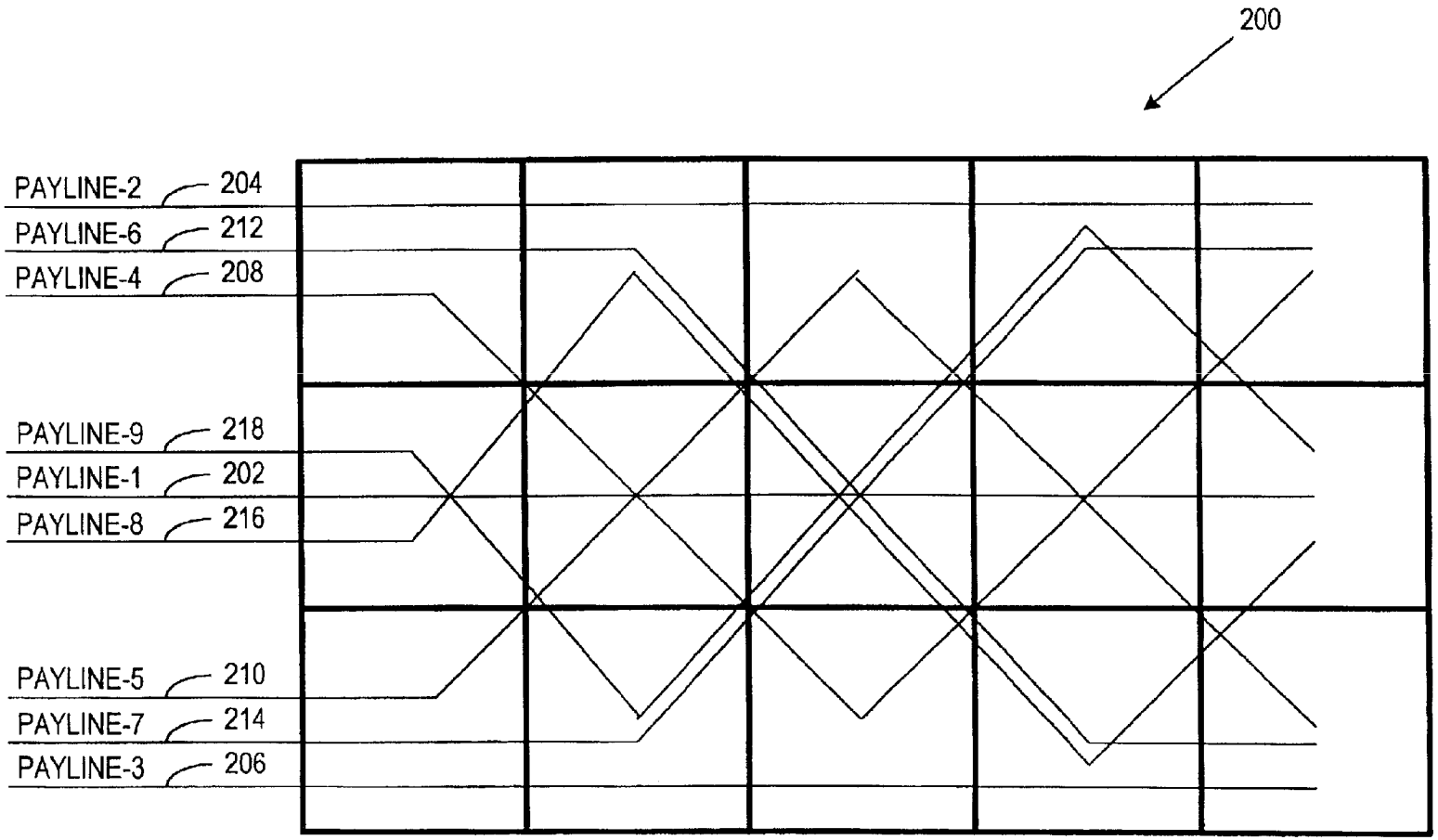
FIG. 2 illustrates a multi-payline display grid in which the principles of the present invention may be applied.

These principles of the present invention apply regardless of the number of paylines or the particular payline configurations. Referring now to FIG. 2, a nine-payline display grid 200 is illustrated. The representative display grid 200 of FIG. 2 is a 5×3 (five column by three row) display. Payline-1 202, payline-2 204, and payline-3 206 are horizontal paylines corresponding to rows of the display grid 200.

Payline-4 208 and payline-5 210 form a V-shape and cut diagonally across the rows of the display grid 200. Payline-6 212 and payline-7 214 are similar to payline-4 208 and payline-5 210 respectively, but are shifted a column to the right. Payline-8 216 and payline-9 218 cut diagonally across the rows of the display grid 200 in a zigzag fashion. These illustrated paylines are illustrated as examples of paylines, and the present invention is applicable to any contrived payline. For example, other payline configurations may include vertical paylines, particularly in video displays where each column of symbols need not necessarily correspond to a unitary "reel" as is the case for most mechanical slot machines. Other payline patterns can also be created, and the principles of the present invention are equally applicable thereto.

Figure 3:
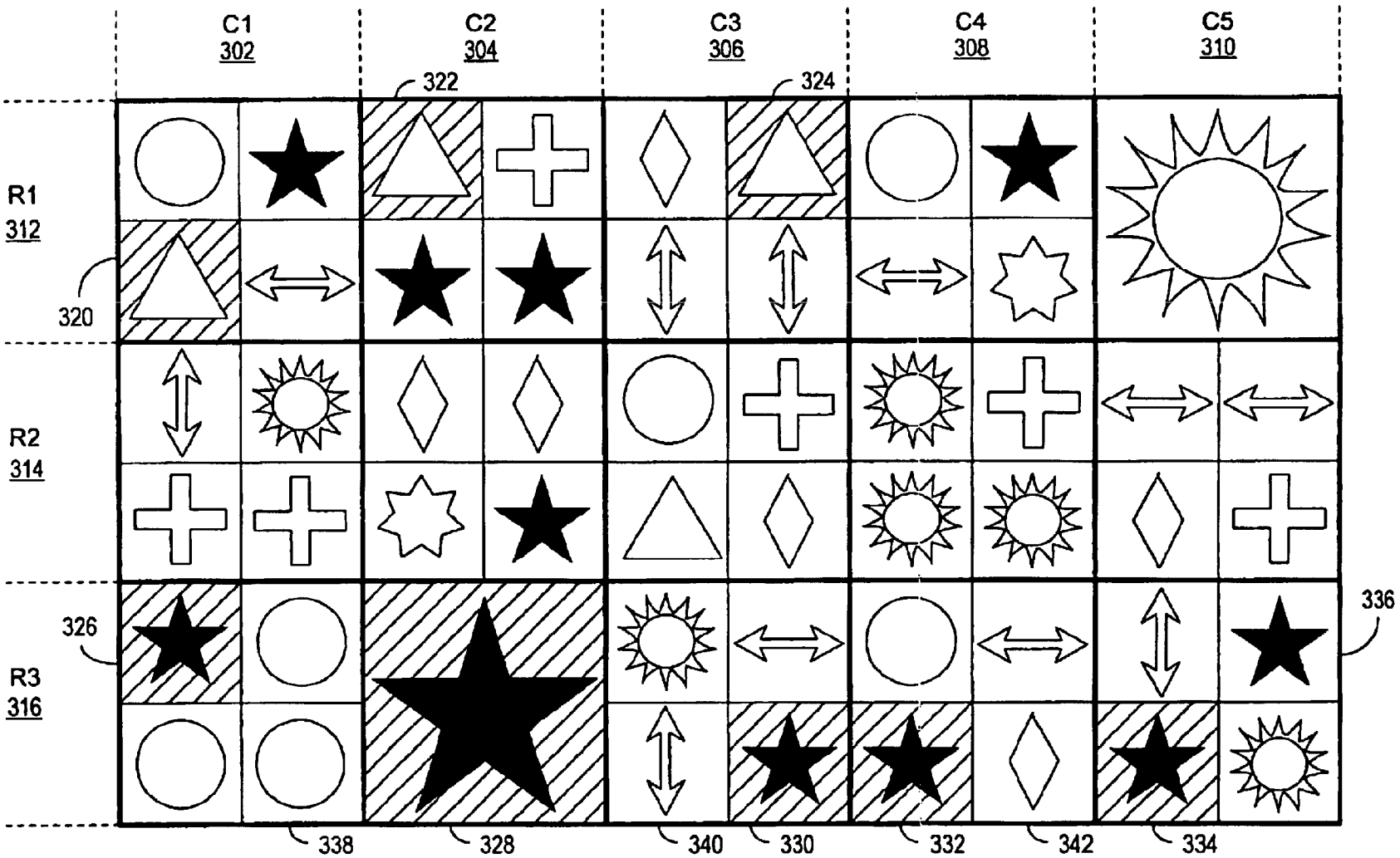
FIG. 3 is a diagram of an exemplary slot game grid in which the principles of the present invention may be employed.

FIG. 3 is a diagram of an exemplary slot game grid 300 in which the principles of the present invention are employed. In this embodiment, the display grid 300 includes five columns C1 302, C2 304, C3 306, C4 308, and C5 310. The grid 300 includes three rows R1 312, R2 314, and R3 316. At the intersection of each column and row is a display segment that forms a section of paylines that traverse that display segment. For example, at the intersection of R1 312 and C1 302 (R1-C1) is a display segment including four display subsegments. Similarly, each of the other display segments are shown at locations R1-C2, R1-C3, R1-C4, R1-C5, R2-C1, R2-C2, R2-C3, R2-C4, R2-C5, R3-C1, R3-C2, R3-C3, R3-C4, and R3-C5.

In accordance with one embodiment of the invention, each of the display subsegments of each display segment is associated with its own reel strip. A reel strip has traditionally referred to the physical strips of symbols attached to mechanical slot machine reels. In a video slot machine, the reel strips are not represented by physical material, but rather include electronically stored symbol patterns, i.e., a virtual reel strip. In one embodiment of the invention, each of the display subsegments is associated with a virtual reel strip, although a particular reel strip may be concurrently used for more than one display subsegment. By using virtual reel strips for each of the display subsegments, there is no physical correlation between display subsegments as there are with mechanical reel strips. For example, in the context of mechanical reel strips, three symbols presented in a column across three paylines are physically restricted to that particular order, since the reel strip is presented across three rows. In an exemplary embodiment of the invention, there is no such relationship between display segments or display subsegments. This allows each display subsegment to present symbols independent of any other display segment or subsegment, and further allows for maximum flexibility in the creation of paylines.

The slot game grid 300 of FIG. 3 illustrates a more particular embodiment of a gaming activity utilizing multi-symbol display segments in accordance with the invention. For purposes of explanation, only horizontal paylines will be assumed in this exemplary embodiment. A first row, R1 312, includes five display segments shown at the intersections of R1-C1, R1-C2, R1-C3, R1-C4, and R1-C5. Assuming that three triangle shapes has been predefined as a winning symbol combination, any three triangle shapes in consecutive display segments in the horizontal payline corresponding to R1 312 will result in a winning payout. In this example, a first triangle symbol is provided in display subsegment 320 of the display segment at R1-C1, a second triangle symbol is provided in display subsegment 322 of the display segment at R1-C2, and a third triangle symbol is provided in display subsegment 324 of the display segment at R1-C3. Because each of the display segments at R1-C1, R1-C2, and R1-C3 include a triangle symbol, the predefined winning symbol combination has occurred, resulting in a payout to the gaming participant.

In accordance with another embodiment of the invention, a different number of display subsegments may be presented in a display segment. For example, in the display segment at the R3-C2 intersection, a single symbol has been presented. This single symbol may be used in various modes. In a first mode, the single symbol presented at the R3-C2 display segment limits the R3-C2 display segment to a single use in formulating a winning symbol combination. In other words, while display segments having multiple display subsegments include a corresponding number of opportunities to formulate a winning symbol combination, a single symbol at the display segment limits the number of opportunities to formulate a winning symbol combination to one. In this example, a predefined winning symbol combination of three or more star symbols results in a winning symbol combination of five star symbols along the horizontal payline corresponding to R3 316. The symbols include the star symbol at display subsegments 326, 328, 330, 332, and 334, even though the display subsegment 328 corresponds to the entire display segment at the R3-C2 intersection.

In one embodiment of the invention, each of the symbols is used only once in formulating a winning payout result. In other words, the star symbol at display subsegment 336 is not used in connection with the star symbols at display subsegments 326, 328, 330, and 332 to formulate another winning payout result. In such an embodiment, either one of the star symbols at display subsegments 334, 336 could be used to formulate the winning symbol combination of five stars on the payline.

In accordance with another embodiment, "each" of the star symbols in display subsegments 334, 336 can be used to formulate a winning symbol combination with display subsegments 326, 328, 330, and 332, which indicates that display subsegments 326, 328, 330, and 332 may be "reused" in formulating additional winning symbol combinations. For example, a first winning symbol combination would include the display subsegments 326, 328, 330, 332, and 334, while a second winning symbol combination would include the display subsegments 326, 328, 330, 332, and 336.

As described above, the use of a single symbol, such as the star symbol shown at the R3-C2 intersection, may be used in various modes. A first mode was described above, where the single symbol is used only once in formulating a winning result. In a second embodiment, the single symbol may be used a predetermined number of times, such as four, which corresponds to the number of display subsegments associated with other display segments. Alternatively, in the second mode, the predetermined number of times in which the single symbol may be used can be "always," such that it may be used as many times as possible, depending on the number of display subsegments utilized in the grid 300. For example, if the grid 300 implemented four display subsegments for each display segment (as depicted in the illustrated example of FIG. 3), the single star symbol at display subsegment 328 could be used in formulating winning payout combinations with all four display subsegments of adjacent display segments. In other words, in this second mode of operation, the single symbol at display subsegment 328 is equivalent to four display subsegments each having a star symbol resulting therein.

In one embodiment, each symbol associated with a display subsegment is used only once in formulating a winning payout result, except as described above for a display subsegment such as display subsegment 328. Multiple winning symbol combinations may, however, be generated using the same symbol on a common payline. For example, the horizontal payline corresponding to R3 316 has already been shown to have generated a winning symbol combination of five star symbols in display subsegments 326, 328, 330, 332, and 334. However, if additional star symbols had been presented in the R3-C1, R3-C3, and R3-C4 display segments, and the second mode of operation were implemented such that the star symbol at display subsegment 328 could be reused, then additional winning star symbol combinations would result. For example, assume that the symbols at display subsegments 338, 340, and 342 were star symbols rather than the symbols displayed, a second winning symbol combination of five star symbols would result in display subsegments 338, 328, 340, 342, and 336. As can be seen, multiple winning symbol combinations may be formulated along a common payline, even where it is the same symbol (e.g., star symbol) creating the multiple winning symbol combinations. Other various payout scenarios may be used in connection with the present invention as well, such as providing the payout based on the highest winning combination along that payline. A variety of different predetermined payout scenarios may be used in connection with the present invention. Further examples will be described below.

Figure 4:
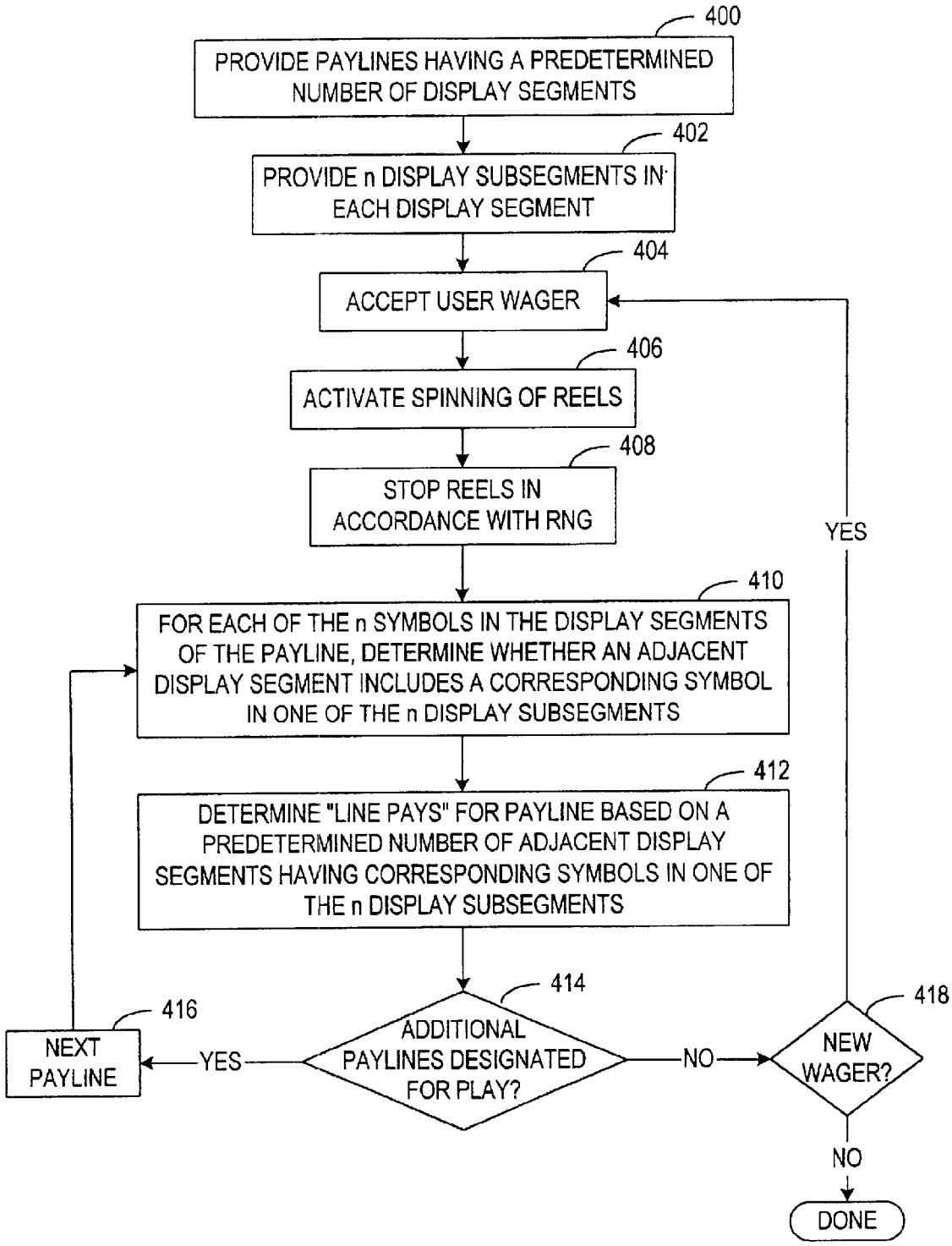
FIG. 4 is a flow diagram of an exemplary embodiment of a method for utilizing multi-symbol display segments in slot game activities in accordance with the invention.

FIG. 4 is a flow diagram of an exemplary embodiment of a method for utilizing multi-symbol display segments in slot game activities in accordance with the invention. A number of available paylines are provided 400, where each payline includes a predetermined number of display segments. The gaming participants need not avail themselves to every payline available in connection with the slot game. In one embodiment, the number of paylines utilized by the gaming participant is dependent on the wager input or otherwise allocated to a particular spin. In other embodiments, the gaming participant can select which one or more of the available paylines in which to participate.

For each display segment, a number n display subsegments are provided 402 in each display segment. In one embodiment each display segment incorporates an equal number of display subsegments, such as four subsegments. In another embodiment, the number of display subsegments varies from display segment to display segment. For example, some display segments may be associated with one display subsegment, others may be associated with two display subsegments, while others still may be associated with three, four, or more display subsegments. In an exemplary embodiment of the invention such as that depicted in connection with FIG. 3, each display segment is capable of presenting different numbers of display subsegments. The example provided in FIG. 3 illustrates that a display segment may present four symbols in corresponding display subsegments, while others present only one symbol in the display segment for a particular spin. On a subsequent spin, a display segment previously displaying only one symbol may display four symbols in corresponding display subsegments.

A user wager is accepted 404, which authorizes the gaming participant to engage in the slot game activity. The reels are spun as shown at block 406, where in one embodiment of the invention each display subsegment is associated with a virtual reel presented on a video display device. The reels are stopped 408 in accordance with a random number generator (RNG) to provide a random (or pseudo-random) outcome for each spin. As shown at block 410, for each of the n symbols in the display segments of a payline, it is determined whether an adjacent display segment includes a corresponding symbol in one of n display subsegments. For example, for each of the display segments in a first display segment, it is determined whether a second, adjacent display segment includes a matching symbol. This is determined for each of the display subsegments associated with each display segment. It is then determined 412 whether any "line pays" have occurred for the payline, which is based on a predetermined number of adjacent display segments having corresponding symbols in one of the n display subsegments. For example, a line pay indicates a winning symbol combination on that payline, where a predetermined number (e.g., three) successive display segments all have a common symbol in one of the n display subsegments of each display segment. Credits, coins, coupons, etc. are awarded for each line pay. If additional paylines have been designated for play as determined at decision block 414, the next payline 416 is considered, which is processed according to blocks 410, 412. If no additional paylines have been designated for play, it is determined 418 whether the gaming participant has submitted a new wager, and if so, processing returns to block 404 to accept the wager, and continue the process.

It should be recognized that although the illustrated embodiment depicts certain functions being performed in series (such as analyzing each payline), this is for purposes of facilitating an understanding of the invention. However, the actual processing may occur in parallel, in series, or a combination thereof. For example, each payline may be analyzed in parallel where the hardware and/or software supports this type of multi-tasking.

Figure 5:
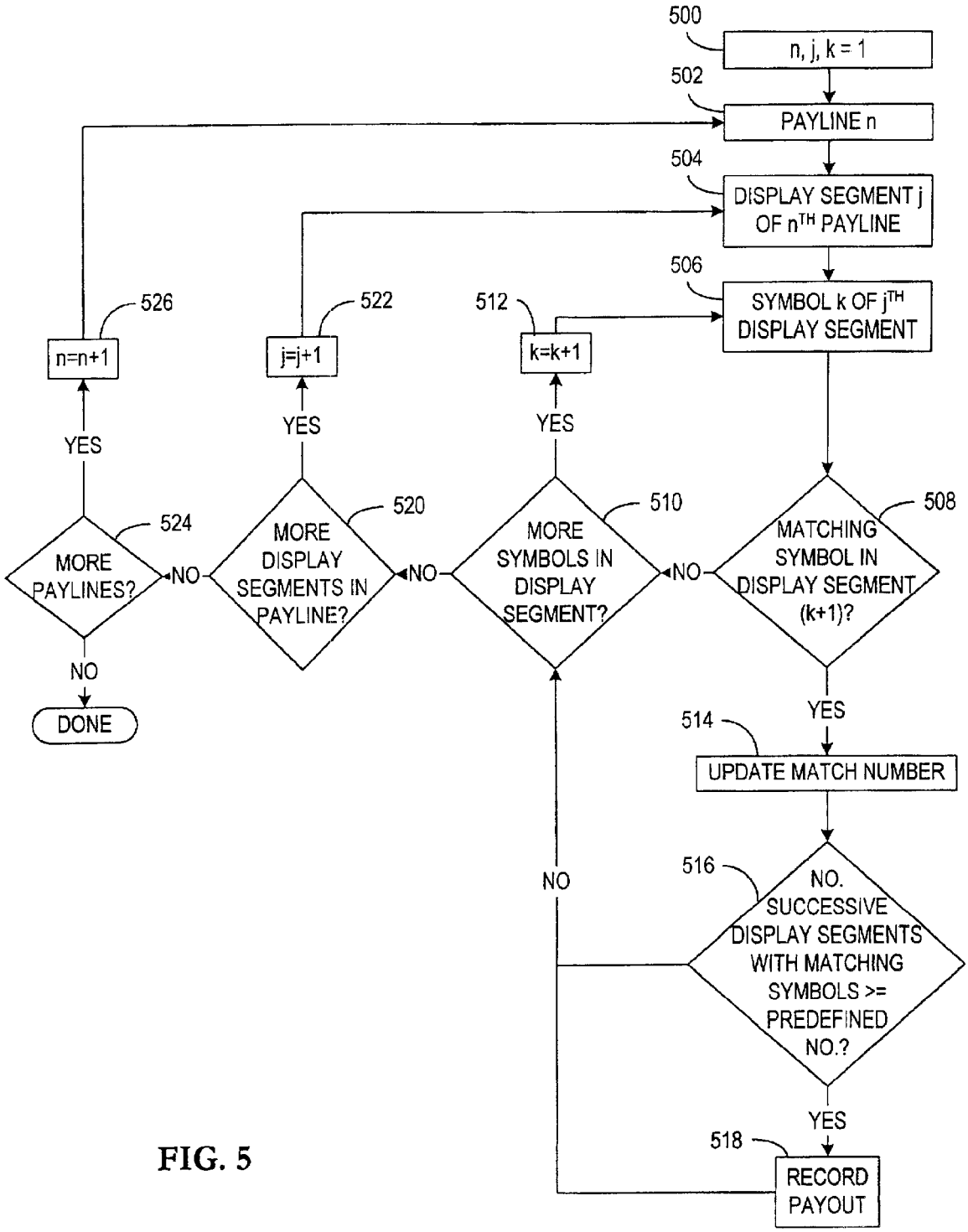
FIG. 5 is a flow diagram of another exemplary embodiment of a method for utilizing multi-symbol display segments in accordance with the present invention.

FIG. 5 is a flow diagram of another exemplary embodiment of a method for utilizing multi-symbol display segments in accordance with the present invention. In this illustration, three variables n, j, and k are set to one as shown at block 500. The use of these variables is to describe one aspect of the invention. However, the actual implementation need not actually employ such variables.

As shown at blocks 502, 504, and 506, payline n, display segment j of the nth payline, and symbol k of the jth display segment are first considered, where n, j, and k are initially set to one. After a spin, it is determined 508 whether there are any matching symbols in an adjacent display segment, namely, display segment (k+1). If not, it is determined 510 whether there are more symbols (i.e., more display subsegments) in the display segments. If so, the next symbol in a corresponding display subsegment is considered by incrementing k, as shown at block 512, and returning to block 506 where the next symbol is considered. This continues until all symbols in display segment j have been considered.

If it is determined that a matching symbol is discovered in display segment (k+1) as determined at decision block 508, it is determined 516 whether a predetermined number of successive display segments with matching symbols is greater than or equal to a predefined number. For example, for the particular symbol k, it may be predefined that five consecutive or adjacent display segments are required in order to result in a winning symbol combination. Therefore, as the process depicted by FIG. 5 continues, values may be temporarily stored to record how many successive display segments have the symbol k associated therewith. This temporary storing of such values is shown at block 514, where the number of successive symbol matches is updated. If the number of matching symbols in successive/adjacent display segments has not reached the predefined requisite number as determined at decision block 516, processing continues by determining 510 whether more symbols need to be considered in display segment j. If the predefined requisite number has not been reached, the next symbol in a corresponding display subsegment is considered by incrementing k, as shown at block 512, and returning to block 506 where the next symbol is considered. If the predefined requisite number has been reached, a payout amount is recorded 518, and it is again determined 510 whether more symbols need to be considered in display segment j.

When all symbols associated with display segment j have been considered as determined at decision block 510, it is determined 520 whether there are more display segments in payline n. If so, the next display segment of the payline is considered by incrementing j, as shown at block 522, and returning to block 504 where the next display segment is considered. This continues until all display segments of the payline n have been considered.

When all display segments associated with the payline n have been considered as determined at decision block 520, it is determined 524 whether there are more active paylines in which the gaming participant has identified for play. If not, analysis of that particular slot game spin is complete. If there are more paylines to consider, the next payline is considered by incrementing n, as shown at block 526, and returning to block 502 where the next payline is considered. This continues until all paylines have been considered.

In this manner, each of the symbols corresponding to display subsegments of each display segment and payline is considered. Again, it should be recognized that although the illustrated embodiment of FIG. 5 depicts certain functions being performed in series, this is for purposes of facilitating an understanding of the invention. The actual processing may occur in parallel, in series, or a combination thereof.

Figure 6:
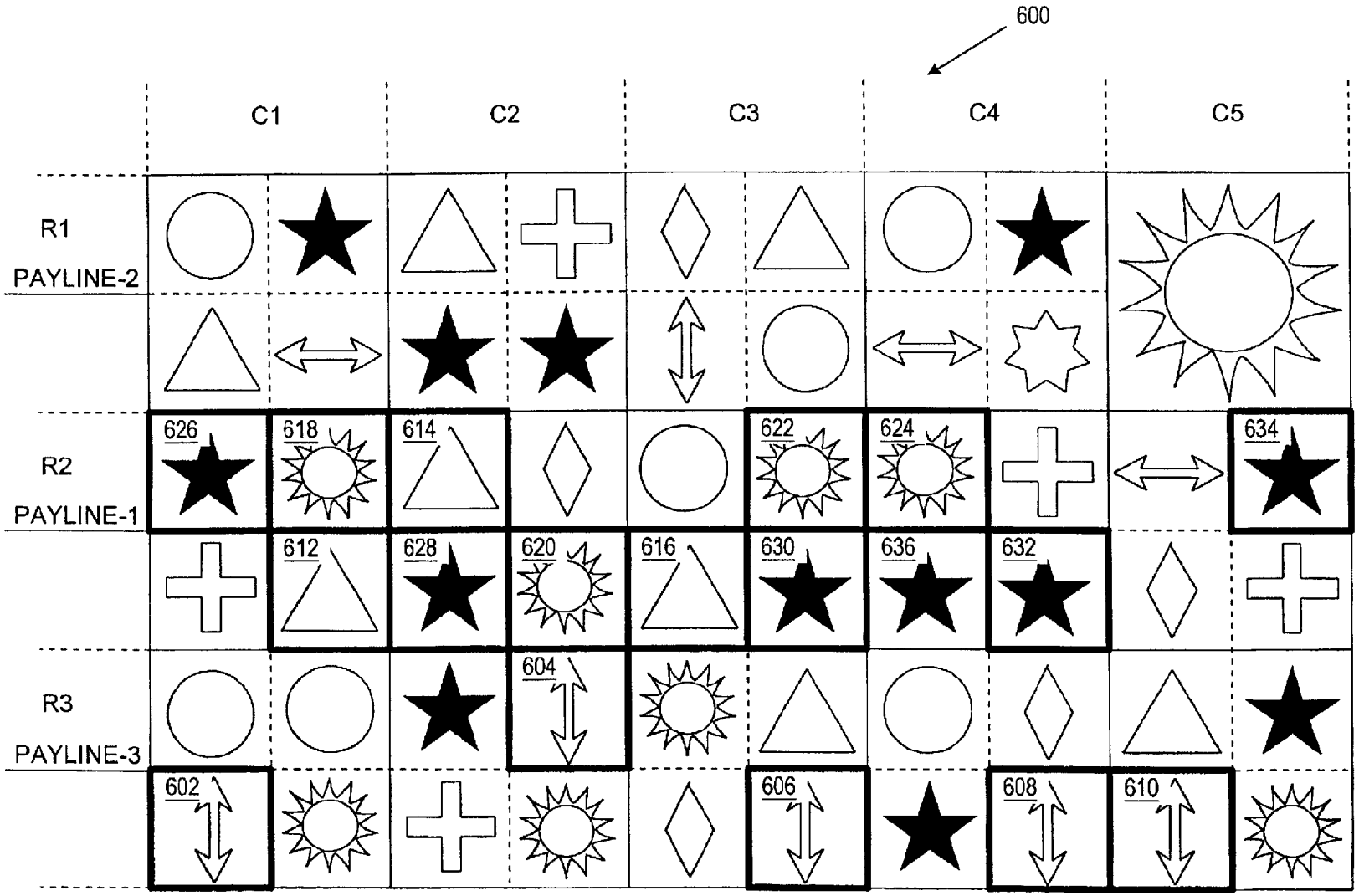
FIGS. 6 and 7 provide examples of particular embodiments of a slot gaming activity utilizing multi-symbol display segments in accordance with the invention.
Figure 7:
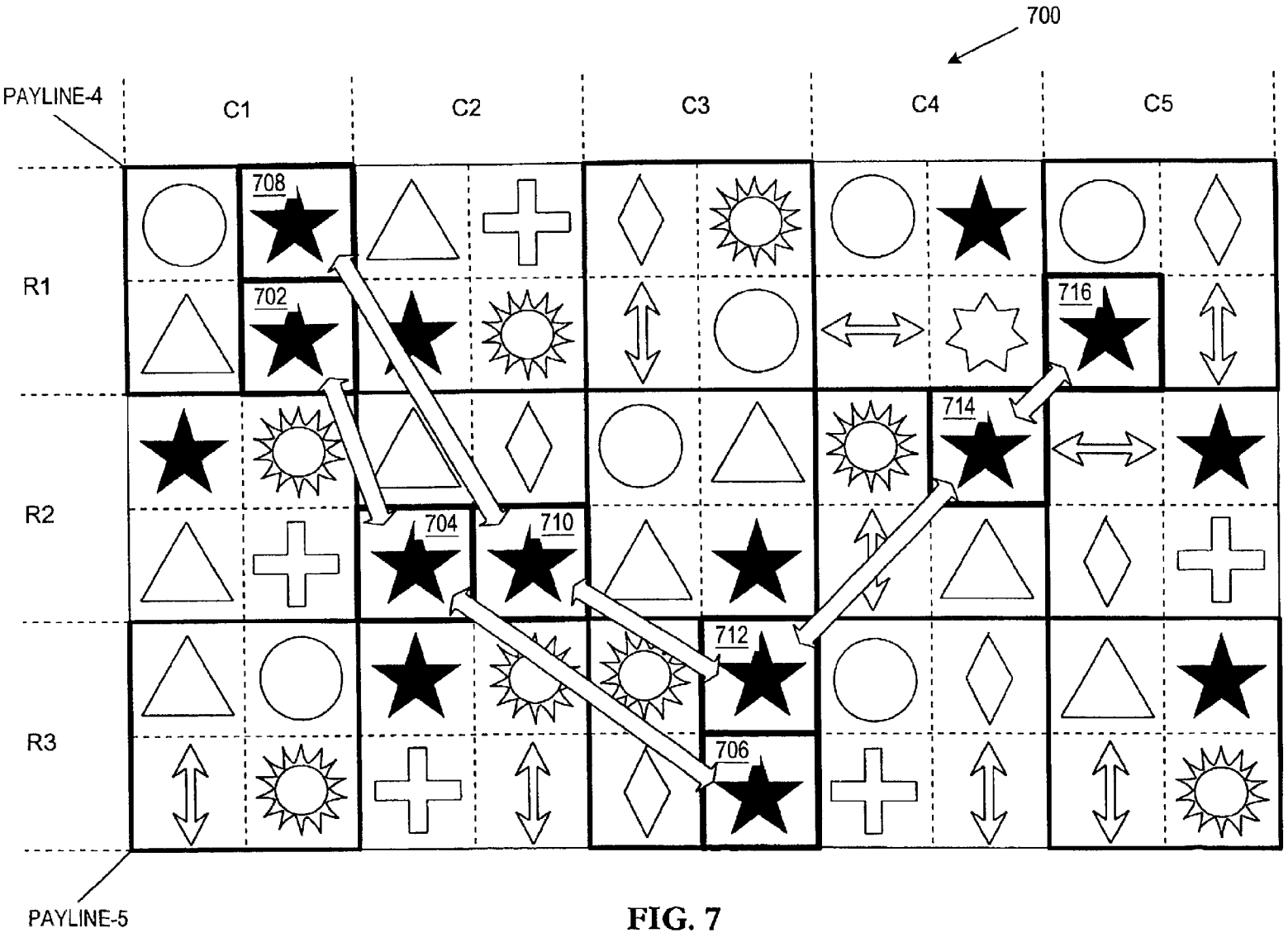

FIGS. 6 and 7 provide additional examples of particular embodiments of a slot gaming activity utilizing multi-symbol display segments in accordance with the invention. FIG. 6 provides an exemplary embodiment where horizontal paylines are considered, and FIG. 7 provides an embodiment of the invention where paylines other than horizontal paylines are designated for play.

Referring first to FIG. 6, only horizontal paylines are considered, although other paylines may be played in addition to payline-1, payline-2, and payline-3 illustrated in FIG. 6. The display grid 600 includes three rows in this example, including a first row R1, a second row R2, and a third row R3. Five columns are illustrated, including columns C1, C2, C3, C4, and C5. The three-row, five-column grid 600 results in a 5×3 gaming configuration having fifteen display segments. These display segments are identified by their row/column intersection. For example, display segment R2-C3 is the center display segment at the intersection of row R2 and column C3.

Payline-3, corresponding to row R3 in this example, includes display segments R3-C1, R3-C2, R3-C3, R3-C4, and R3-C5. This payline illustrates a winning symbol combination where five vertical arrow symbols is predefined as a winning symbol combination. In this example, one vertical arrow symbol is present in each of the display segments R3-C1, R3-C2, R3-C3, R3-C4, and R3-C5 at display subsegments 602, 604, 606, 608, and 610 respectively. This illustrates how a winning combination can be made on a payline using symbols from any of the display subsegments of the display segments.

The center payline, payline-1, illustrates how multiple winning symbol combinations can be made on the same payline. Assuming that at least three matching symbols is a winning symbol combination for the star, sun, and triangle symbols, payline-1 includes multiple winning symbol combinations. Three consecutive display segments, R2-C1, R2-C2, and R2-C3 each include a display subsegment having a triangle symbol. More particularly, display subsegments 612, 614, and 616 occurring in consecutive display segments R2-C1, R2-C2, and R2-C3 include triangle symbols, thereby resulting in a winning symbol combination for payline-2.

A higher payout may be awarded for additional symbols beyond the minimum three symbols required to establish a winning symbol combination. For example, also in payline-2 are four consecutive display segments, R2-C1, R2-C2, R2-C3, and R2-C4 each include a display subsegment having a sun symbol. More particularly, display subsegments 618, 620, 622, and 624 occurring in consecutive display segments R2-C1, R2-C2, R2-C3, and R2-C4 include sun symbols, thereby resulting in another winning symbol combination for payline-2. A first payout amount may be associated with three consecutive sun symbols, and a higher, second payout amount may be associated with four consecutive sun symbols.

Payline-1 includes yet another winning symbol combination. Five star symbols at display subsegments 626, 628, 630, 632, and 634 result in each of the display segments R2-C1, R2-C2, R2-C3, R2-C4, and R2-C5 having a star symbol. In this example, one display segment R2-C4 includes two star symbols at display subsegments 632 and 636. Either of these display subsegments could be used to establish the resulting winning symbol combination. If each of the display segments included two star symbols, then two winning symbol combinations of star symbols would result. Alternatively, even if in the illustrated embodiment display segments R2-C3 and R2-C5 included two star symbols, a second winning combination of three star symbols would result at display segments R2-C3, R2-C4, and R2-C5 by using the additional star symbols not used in the formulation of the first five-star winning symbol combination. As can be seen, a given payline may produce multiple winning symbol combinations in accordance with the invention.

FIG. 7 illustrates an embodiment in which diagonal or otherwise non-horizontal paylines are implemented in connection with the multi-symbol display segments according to the invention. In this example, two paylines in addition to the three paylines of FIG. 6 are shown on the display grid 700. These paylines are identified as payline-4 and payline-5. Payline-4 includes the display segments R1-C1, R2-C2, R3-C3, R2-C4, and R1-C5 to form a V-shape. Payline-5 includes the display segments R3-C1, R2-C2, R1-C3, R2-C4, and R3-C5 to form an inverted V-shape.

In this example, two winning symbol combinations have resulted along the display segments corresponding to payline-4. A first three-symbol winning symbol combination includes display segments R1-C1, R2-C2, and R3-C3 where display subsegments 702, 704, and 706 formulate a winning symbol combination (assuming that three star symbols has been predefined as a winning symbol combination). However, because each of the display segments R1-C1, R2-C2, and R3-C3 include two star symbols therein at display subsegments 708, 710, and 712 respectively, another winning symbol combination is formed. Furthermore, because additional display segments along payline-4 include star symbols in corresponding display subsegments, a higher payout winning symbol combination results. More particularly, the star symbol at display subsegment 714 and the star symbol at display subsegment 716 result in a five-symbol winning combination along each of the display segments of payline-4.

Figure 8:
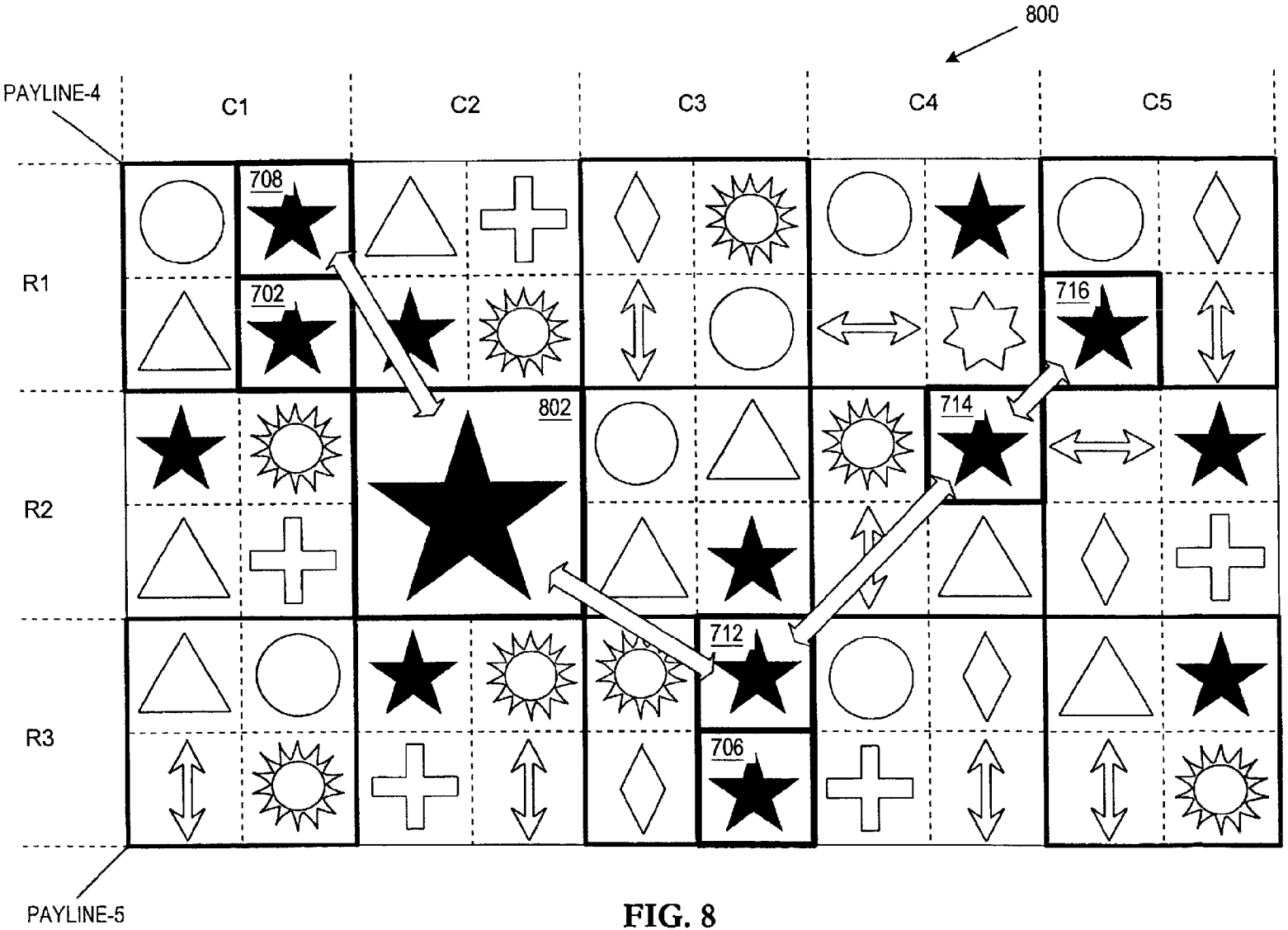
FIG. 8 illustrates an embodiment in which different numbers of display subsegments in the display segments are implemented in connection with the multi-symbol display segments according to the invention.

FIG. 8 illustrates an embodiment in which different numbers of display subsegments in the display segments are implemented in connection with the multi-symbol display segments according to the invention. The same paylines shown in FIG. 7 are shown in the slot game grid 800 of FIG. 8. FIG. 8 differs from FIG. 7 in that display segment 802 (R2-C2) includes a single symbol. In accordance with a first mode, the single star symbol occupying entire display segment 802 (and correspondingly the sole display subsegment) may be used only once, resulting in the loss of one winning symbol combination that was identified in FIG. 7. More particularly, because the star symbol at display segment 802 can only be used once in the first mode, the best possible payout is derived using the display segment 802. which results in the five-symbol combination of display subsegments 708, 802, 712, 714, and 716. The remaining three-symbol winning combination shown in FIG. 7 that included display subsegments 702, 704, and 706 is no longer a winning symbol combination. In accordance with a second mode, the single star symbol occupying display segment 802 may be reused, such that this "big" symbol is equivalent to having multiple display subsegments in the display segment having all star symbols. In this case, the big star symbol at display segment 802 serves as a legitimate symbol for both winning symbol combinations shown in FIG. 7. As can be seen, a "big" symbol associated with a display segment can serve as a limiting characteristic to the gaming participant in the first mode, and a desirable characteristic to the gaming participant in the second mode.

The examples shown in FIGS. 6 and 7 were described in connection with horizontal and certain V-shaped paylines. It will be appreciated by those skilled in the art that the present invention is equally applicable to additional payline configurations, such as those illustrated in FIG. 2, as well as others.

The manner in which the gaming participant wagers coins, credits, or other wager units may vary in accordance with the invention. For example, a participant may wager one coin per payline to activate only one display subsegment in each display segment. The participant may be required to wager four wager units to activate four display subsegments, six wager units to activate six display subsegments, etc. Other embodiments multiply the predetermined amount by the number of paylines played by the participant. For example, where nine paylines are being played, and the user wants to utilize all eight display subsegments associated with each display segment, the user may be required to wager seventy-two wager units (nine paylines times eight display subsegments per display segment). Any predetermined manner of wagering may be employed in accordance with the invention.

Figure 9:
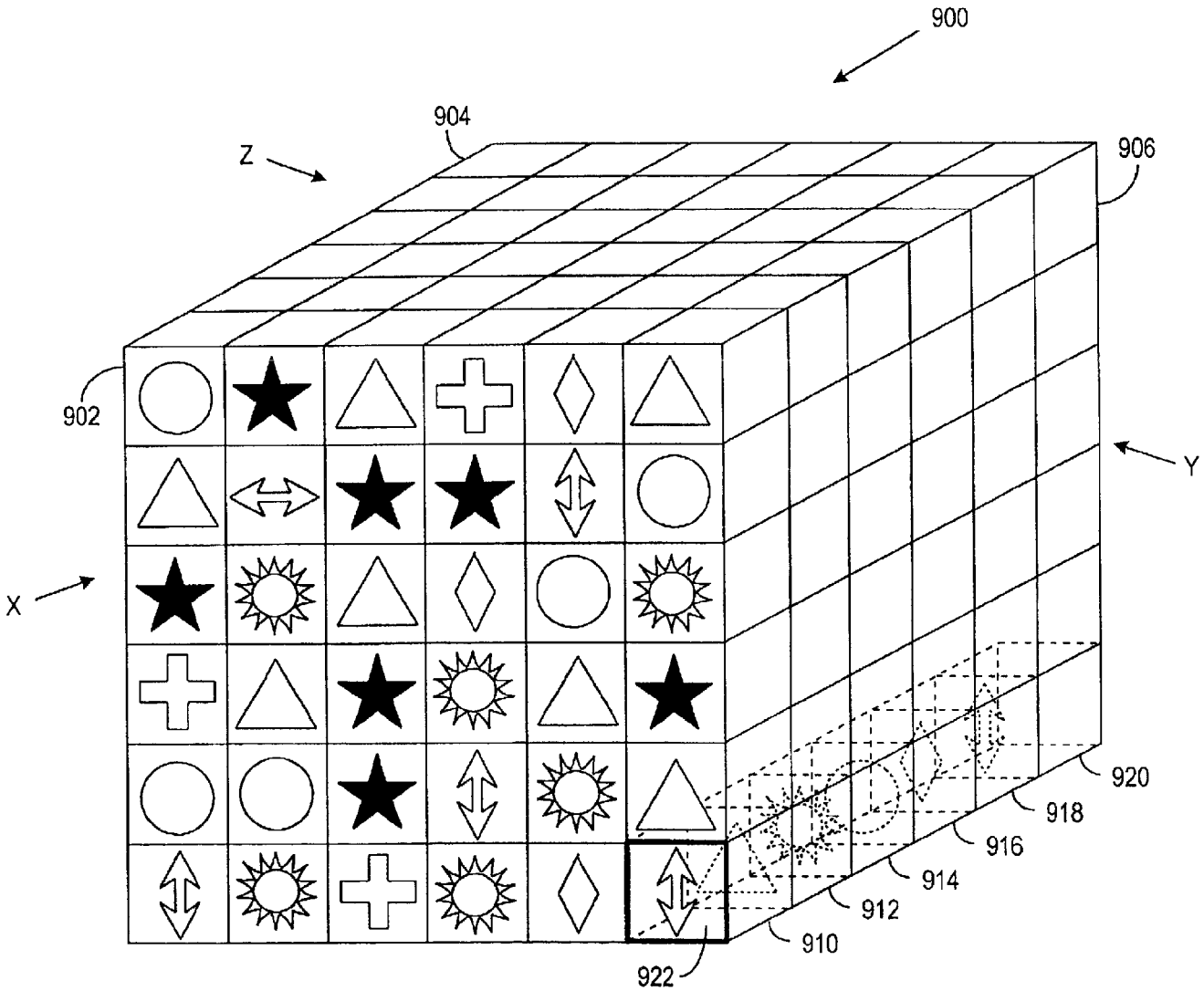
FIG. 9 illustrates an embodiment of a slot gaming activity utilizing multi-symbol display segments in a three-dimensional (3D) array in accordance with the invention.

FIG. 9 illustrates an embodiment of a slot gaming activity utilizing multi-symbol display segments in a three-dimensional (3D) array in accordance with the invention. In this embodiment, rather than having the multiple symbols per display segment presented in a two-dimensional array, the multiple symbols are presented on different faces, X, Y, Z, of a 3D display cube 900. Corresponding locations on each of the cube 900 faces can provide the multiple symbols for a particular display segment. For example, corresponding display subsegments 902, 904, and 906 may provide the multiple symbols corresponding to a particular display segment.

Other manners of arranging the display subsegments of each display segment may also be used. For example, the multiple symbols for each "display segment" can be each of the faces of each individual cube of the entire display cube 900. As a more particular example, the block 902 may represent a display segment 902, which is a 3D cube having six faces although some of the faces are not visible as it is currently displayed. Each of these faces may represent a display subsegment of the display segment 902. Such a particular embodiment would result in six display subsegments per display segment, and paylines can be any predetermined payline throughout the 3D display cube 900. As will be described more fully below, other embodiments include dynamically-generated paylines which are not predetermined, but rather arise as a result of the occurrence of a predetermined number of adjacent matching symbols. After a spin has stopped, the cube 900 can remain stationary to allow the gaming participant a static view of the cube 900, or alternatively the cube can rotate to allow the participant to more easily view each face X, Y, Z of the cube 900, and each face of various layers throughout the cube 900. As can be seen, a great number of different paylines, whether predetermined or dynamically-generated, can be made available using an embodiment such as that described in connection with FIG. 9.

In yet another embodiment, each of the individual cubes of a predetermined path through the cube 900 represents the multiple symbols relating to a display segment. For example, a symbol on each of the individual cubes 910, 912, 914, 916, 918, 920 may represent the display subsegments of a particular display segment 922. Each of the symbols associated with individual cubes 910, 912, 914, 916, 918, 920 can then be used in connection with the display segment 922 to formulate a potential winning payline. The paylines formed by the display segments may be horizontal, vertical, diagonal, scatter pay, any other predetermined pattern, or a dynamically-generated payline of adjacent matching symbols as described more fully below.

Figure 10:
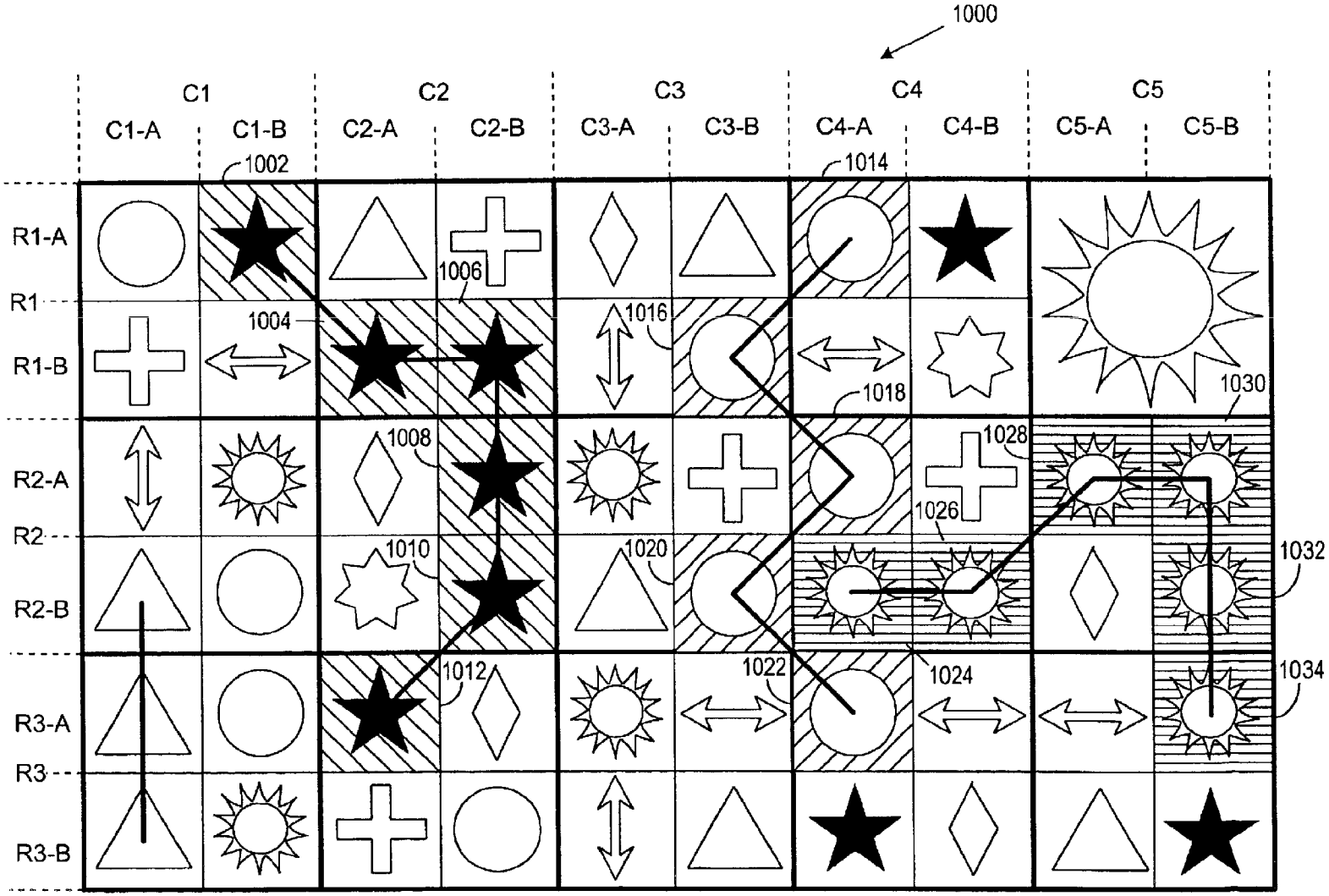
FIG. 10 illustrates an exemplary embodiment of the formation of adjacent, free-forming paylines in accordance with the present invention.

Secondary or otherwise alternative manners of creating paylines using the multiple symbols is also provided. Referring to FIG. 10, an exemplary embodiment is illustrated of adjacent, free-forming paylines in accordance with the present invention. As will be described more fully below, such an embodiment may be used as a secondary manner of providing winning payouts with respect to the multi-symbol display segments described above, or may be used in a bonus mode, or may be operated independently. In this mode, the multiple symbols within each display segment become independent of the overlay grid. For example, the grid 1000 illustrated in FIG. 10 has an overlay grid of three rows by five columns (i.e., a 5×3 overlay grid). In a secondary mode of operation, this overlay is essentially removed, resulting in a grid of six rows by ten columns (i.e., a 10×6 grid).

In a first embodiment, this mode of operation is triggered upon completion of the primary multi-symbol game being complete and all paylines considered for winning symbol combinations. After the winning symbol combinations have been handled along the predetermined paylines, the secondary mode can be initiated, providing additional results without requiring a new spin by the gaming participant. Any number of predetermined triggering events can initiate such a mode of operation. As another example, if the gaming participant does not win in the primary mode of operation using multiple display subsegments in each display segment, the secondary mode may be initiated. Alternatively, the secondary mode may be played in connection with a bonus event, such that achieving a predetermined symbol combination in the primary mode of play results in a bonus activity as shown in FIG. 10. In other embodiment, this "secondary" mode can be independent of any primary game, and may itself be the primary game.

To illustrate its operation, this embodiment essentially disregards any overlaying grid, and views each of the display subsegments as independent display segments. Paylines are dynamically created through achievement of a predetermined number of symbols that are "adjacent" to one another. Symbols that are adjacent may be positioned vertically, horizontally, or diagonally. For example, a string of six star symbols are shown as adjacent matching symbols, thereby dynamically creating a payline based on a predetermined number of matching and adjacent symbols. The six matching star symbols at grid locations 1002, 1004, 1006, 1008, 1010, and 1012 provide a payout to the gaming participant, assuming, for example, that six adjacent star symbols is equal to or greater than a requisite number of star symbols required to result in a winning symbol combination. Additional winning dynamic paylines are also illustrated in FIG. 10, including the five-circle winning combination at grid locations 1014, 1016, 1018, 1020, and 1022. Another winning payline is illustrated at grid locations 1024, 1026, 1028, 1030, 1032, and 1034. As can be seen by the foregoing example, paylines are not predetermined, and are not selected by the user. Rather, paylines are dynamically generated based on the number of matching symbols that are presented adjacent to one another.

Other patterns may be provided as well. For example, in one embodiment, only those symbols that are adjacent in a horizontal or vertical fashion will be deemed "adjacent" for purposes of providing a payout. Alternatively, only symbols that are horizontal, or that are vertical, or that are diagonal, may be deemed adjacent. Symbols may also be deemed adjacent along opposite edges of the display grid, as if the edges were wrapped around to intersect with one another. For example, in one embodiment of the invention, display subsegments at the intersections of R1-A/C2-A and R3-B/C2-A are considered "adjacent." All of the display subsegments in row R1-A would be considered adjacent to a corresponding one of the display subsegments in row R3-B in such an embodiment which in effect assumes that the display grid 1000 is cylindrical along a horizontal axis. An analogous embodiment may assume a cylindrical display grid 1000 along a vertical axis, thereby making display subsegments along column C1-A adjacent to corresponding display subsegments along column C5-B. Three-dimensional such as that depicted in FIG. 9 may also be used, such that any adjacent display segment or subsegment on the face and/or within the body of the display cube is "adjacent" for purposes of dynamically generating paylines. Regardless of the particular manner in which adjacency is defined, the paylines are randomly generated in accordance with the resulting symbols presented in the display grid 1000.

A number of particular resulting adjacent symbols required to provide a payout may be determined in advance. For example, it may be determined in advance that a minimum of "x" adjacent star symbols results in a winning payout. In one embodiment, an increasing payout is provided for each additional adjacent symbol exceeding the minimum to provide a payout. For instance, it may be determined that five adjacent star symbols provides a payout of ten times the wager placed, and each additional adjacent star symbol doubles the payout value (e.g., six adjacent star symbols provides a payout of twenty times the wager placed, seven adjacent star symbols provides a payout of forty times the wager placed, etc.). Any predetermined payout schedule may be provided in connection with the invention.

Further, different symbols may require different numbers of adjacent matching symbols to provide a winning payout combination. For example, it may require a minimum of five of a first symbol to provide a winning payout, but may only require three of a second symbol to provide a winning payout. Some symbols may provide no payout, regardless of the consecutive number of adjacent matching symbols. These scenarios may be determined in advance.

In another embodiment, the gaming participant selects one or more symbols that will be played. In such an embodiment, the participant is afforded an opportunity to select which one or more symbols to play, in the hopes that a predetermined number of adjacent ones of the selected symbols will result. This selection may be accomplished via a user interface. One particular embodiment includes requiring increasing wager amounts for each symbol selected. For example, a first wager amount may be required if the user selects only one symbol, and an increased wager may be required for increased numbers of selected symbols.

Figure 11:
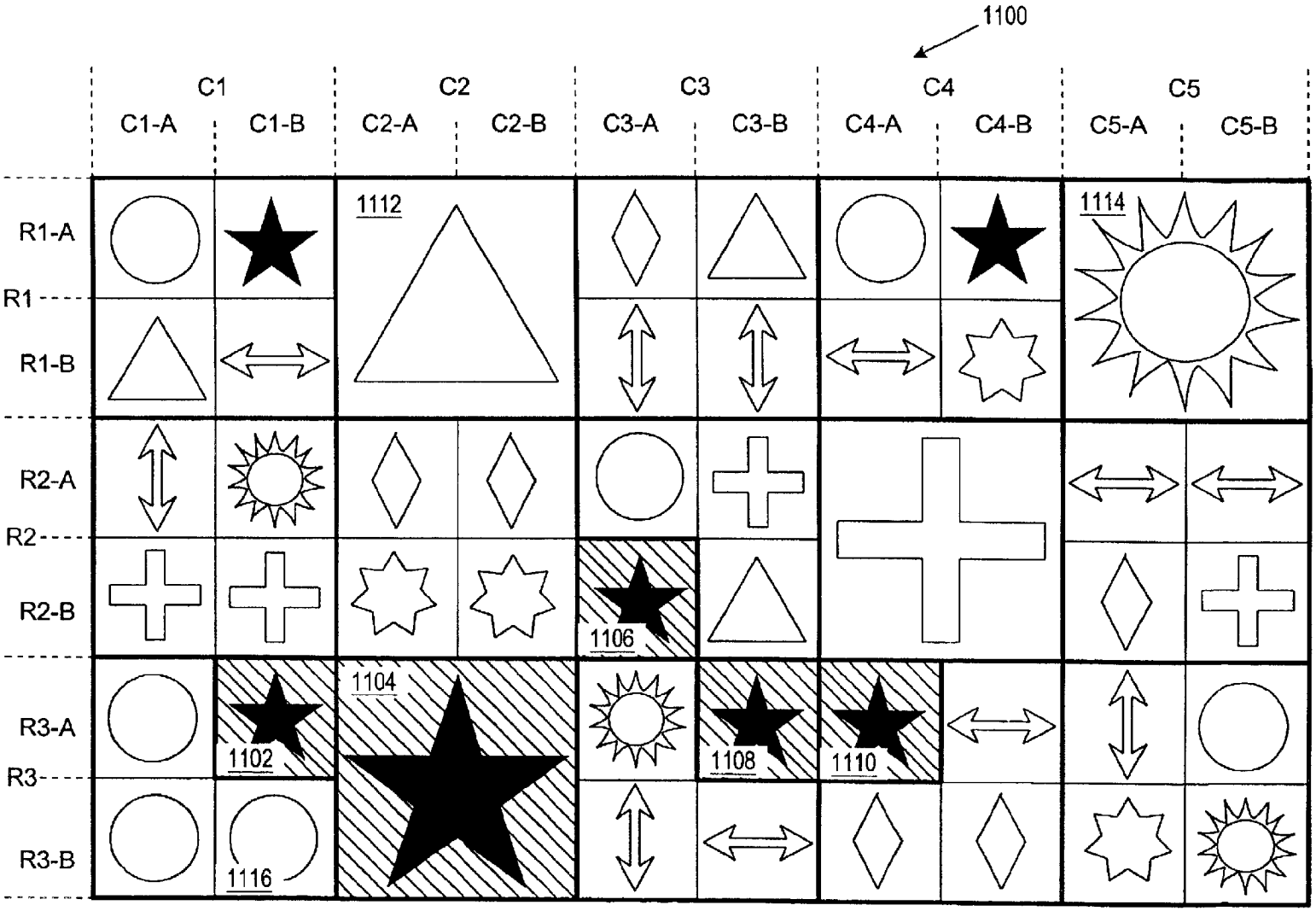
FIGS. 11–13 illustrate various embodiments of the dynamic generation of paylines in connection with a multi-symbol grid in accordance with the invention.

FIG. 11 illustrates another embodiment of the dynamic generation of paylines in connection with the multi-symbol grid 1100 in accordance with the invention. In the illustrated embodiment, some of the display segments present a reduced number of display subsegments, such as to one display subsegment corresponding to the display segment. Display segments 1104, 1112, and 1114 illustrate examples where a single symbol is presented in the display segment, rather than the four display subsegments presented in each of the other display segments. Paylines can be dynamically generated in a manner similar to that described in connection with FIG. 10.

More particularly, the single star symbol presented in display segment 1104 is shown to be adjacent to the star symbols in display subsegments 1102 and 1106. Display subsegment 1106 is in turn adjacent to display subsegment 1108, which is in turn adjacent to display subsegment 1110. This results in a five-symbol dynamically-generated payline. The result would be the same had the star symbol been presented in display subsegment 1116 rather than display subsegment 1102, since display subsegment 1116 is still adjacent to display segment 1104.

Figure 12:
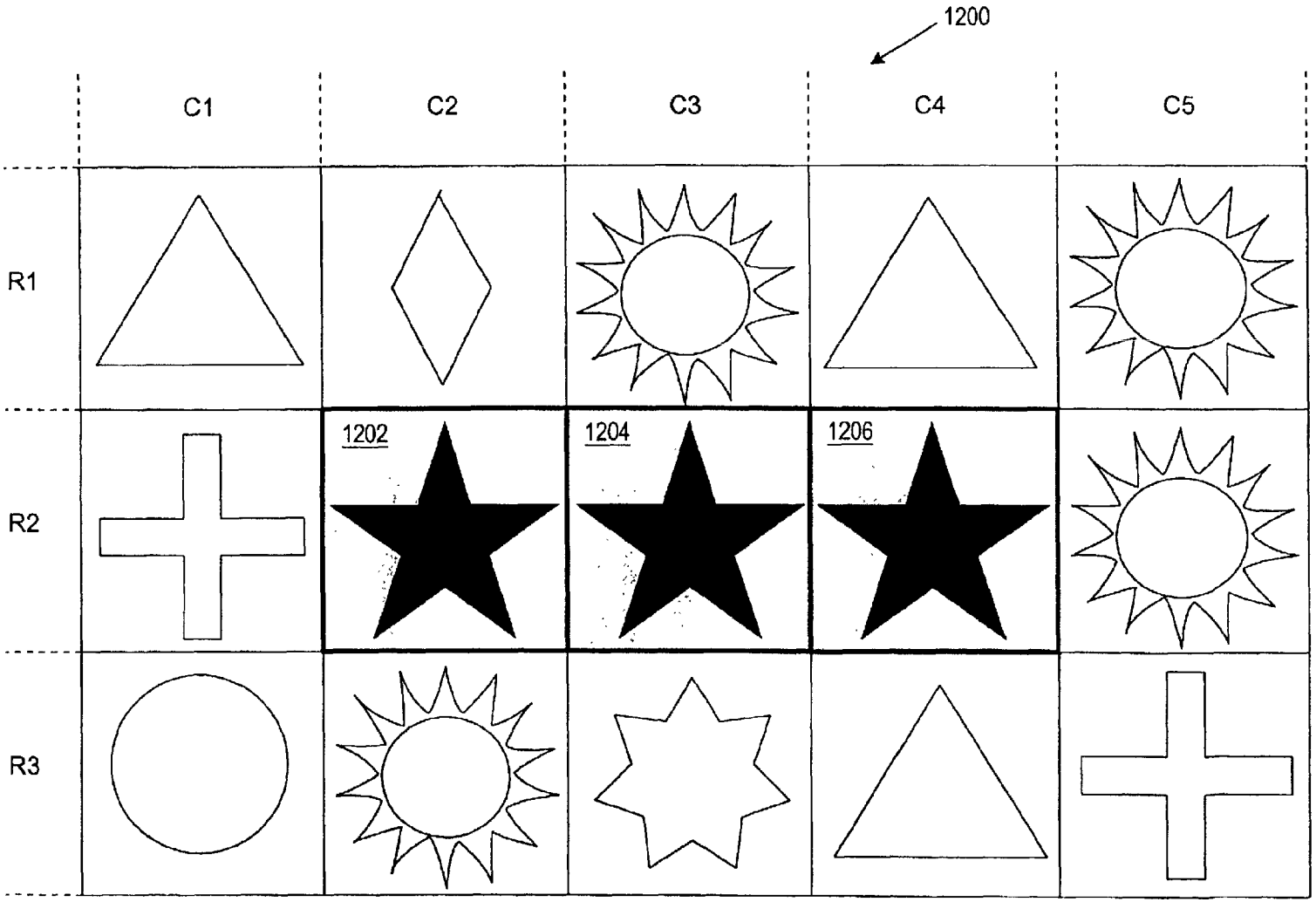

FIG. 12 illustrates another embodiment of the dynamic generation of paylines in connection with the grid 1200 in accordance with the invention. In the illustrated embodiment, all of the display segments present a reduced number of display subsegments, which in this example is one display subsegment per display segment. This also corresponds to a standard slot game grid, which does not utilize multiple symbols per display segment. In either case, the dynamic payline generation in accordance with the invention may be utilized.

Any adjacent symbols presented in the grid 1200 may result in a dynamically-generated payline, assuming that the requisite number of a predetermined symbol has been presented. For example, assuming that three or more star symbols results in a winning symbol combination, the three adjacent star symbols at display segments 1202, 1204, and 1206 results in a winning symbol combination. These three display segment are not designated in advance as a payline, but rather the payline results from the requisite number of adjacent star symbols.

Figure 13:
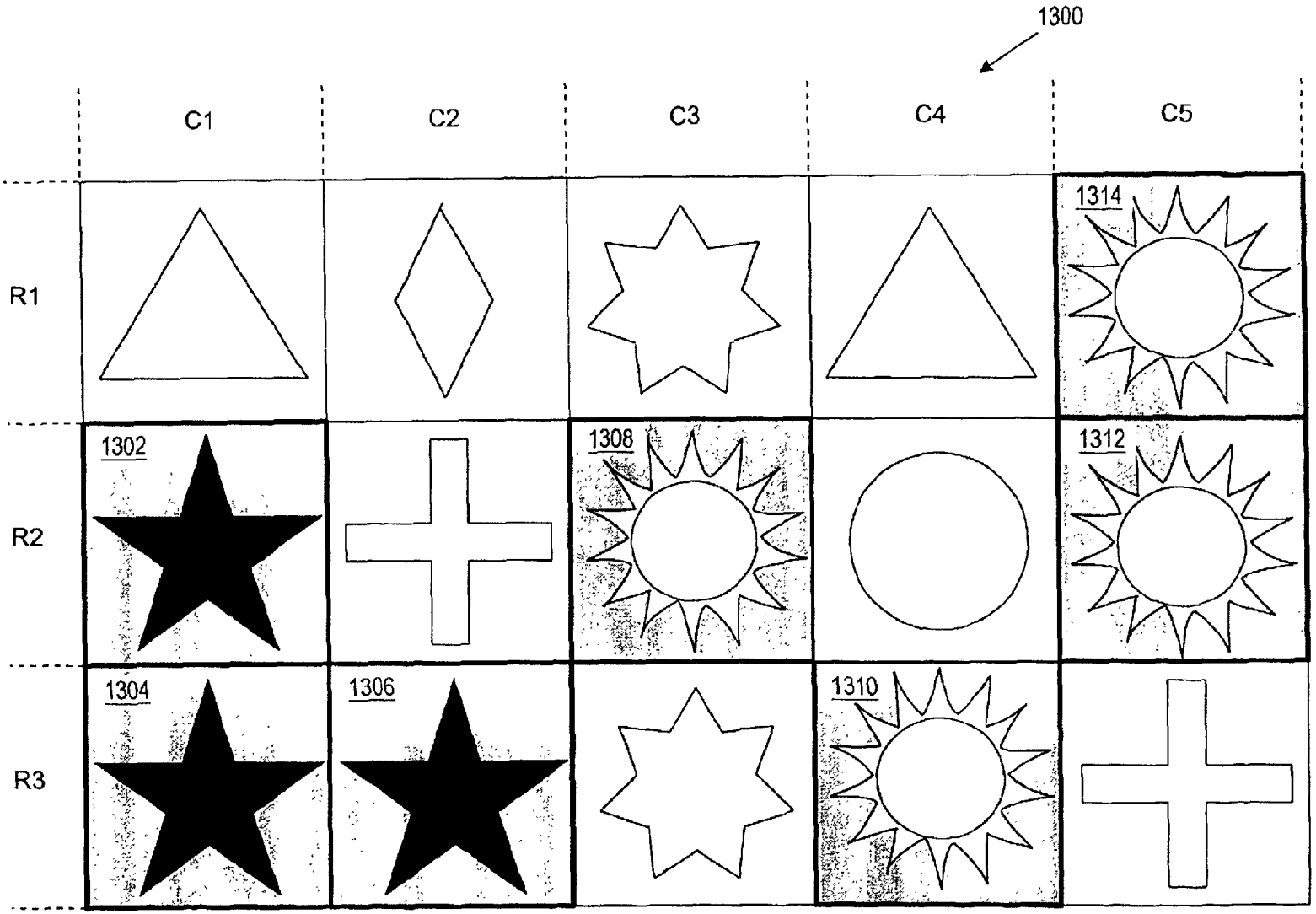

The resulting paylines may be in any pattern or configuration, as long as the matching symbols are adjacent as defined for the particular slot game. For example, referring to FIG. 13, each display subsegment again corresponds to a display segment, but the resulting paylines are not straight-line paylines as was described in connection with FIG. 12. In the example grid 1300 depicted in FIG. 13, two winning symbol combinations result from dynamically-generated generated paylines. A first dynamic payline includes adjacent star symbols at display segments 1300, 1302, and 1304. A second dynamic payline includes adjacent sun symbols at display segments 1306, 1308, 1310, and 1312. As can be seen, any adjacent matching symbols may generate a winning symbol combination on a dynamically-generated payline, if that winning symbol combination meets the predefined requisites of symbol type and number of symbols.

In order to place wagers in connection with the dynamic payline aspect of the invention, a participant can wager on a symbol or a group of symbols. For example, the user may wager that a winning symbol combination will result for the star symbol, and the user may therefore place the wager on the star symbol. The participant may make wagers on additional symbols as well, thereby increasing the chances for a dynamic payline of the selected symbols to be generated. Alternatively, where the dynamic generation of paylines is employed as a secondary or bonus gaming activity, the participant may not be required to make an independent wager on the outcome. For example, the dynamic payline generation mode may be activated as a bonus event, in which case no additional wagers need to be placed, and any predetermined symbol combination occurring on a dynamically-generated payline may be considered as a winning symbol combination.

Figure 14:
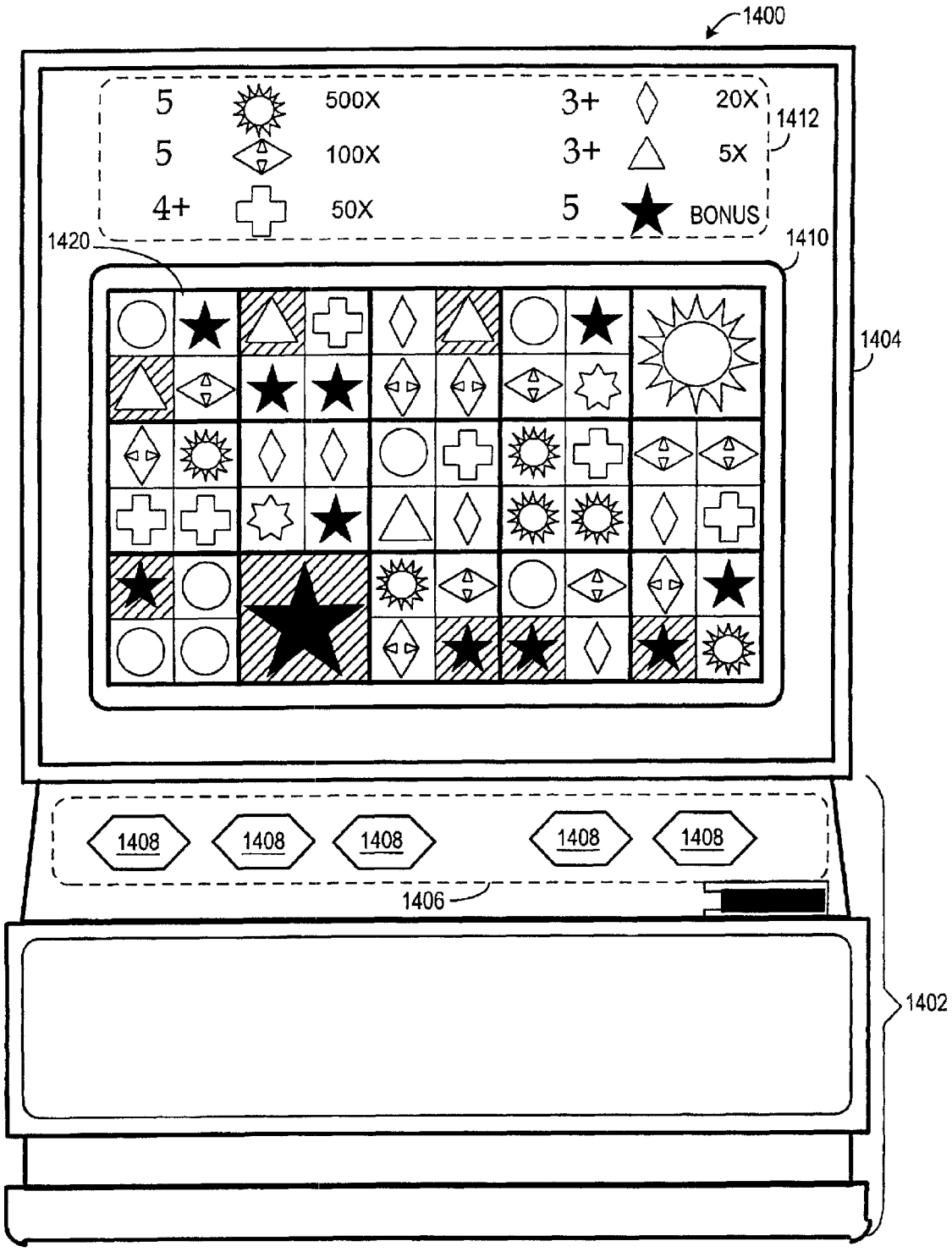
FIG. 14 is an embodiment of a casino-style gaming device in which the principles of the present invention may be applied.

FIG. 14 is an embodiment of a casino-style gaming device in which the principles of the present invention may be applied. The slot machine 1400 is a structure including at least a computing system, a housing, and a display. The housing includes a base 1402 and a display device 1404 to allow the slot machine 1400 to be a self-supported, independent structure. The base 1402 includes structure supporting the slot machine 1400, and also includes a user interface 1406 to allow the user to control and engage in play of the slot machine 1400. The particular user interface mechanisms associated with user interface 1406 is dependent on the type of gaming machine. For example, the user interface 1406 may include one or more buttons, switches, joysticks, levers, pull-down handles, trackballs, voice-activated input, or any other user input system or mechanism that allows the user to participate in the particular gaming activity. The user input 1406 allows the user to enter coins or otherwise obtain credits through vouchers, tokens, credit cards, etc. Various mechanisms for entering such vouchers, tokens, credit cards, coins, point tickets, etc. are known in the art. For example, coin/token input mechanisms, card readers, credit card readers, smart card readers, punch card readers, and other mechanisms may be used to enter wagers. The user input may include a plurality of buttons 1408, which allow the user to initiate the multi-symbol play and dynamic payline play in accordance with the invention, enter a number of credits to play, identify the number of paylines in which to participate, cash out, automatically bet the maximum amount of paylines, etc. It should be recognized that a wide variety of other user interface options are available for use in connection with the present invention, including pressing a button on a gaming machine, touching a segment of a touch-screen, entering text, entering voice commands, or other known user entry methodology.

Figure 15:
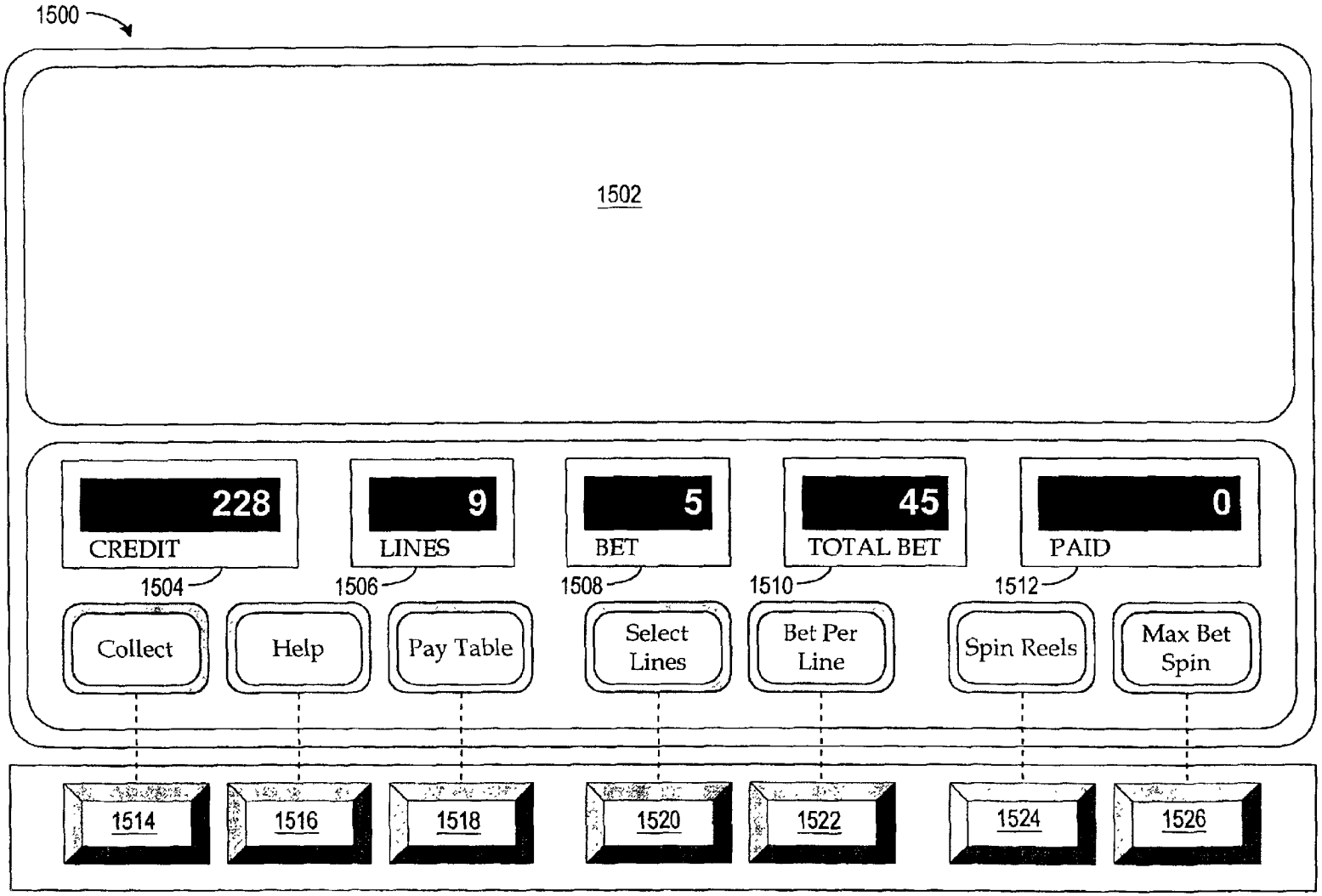
FIG. 15 illustrates an exemplary embodiment of a user interface for a slot machine in which the principles of the present invention may be applied.

Referring briefly to FIG. 15, a more particular embodiment of a user interface for a slot machine 1500 is illustrated. The display area 1502 provides a display of the gaming activity in accordance with the invention. A number of information display segments 1504, 1506, 1508, 1510, 1512 display information such as the accumulated credits, paylines played, amount wagered, total wager, and amount paid respectively. Selection of a button causes an action associated with that button. For example, selection of button 1514 allows the participant to collect the amount associated with the credit accumulation. Pressing button 1516 provides the participant with help information, and pressing button 1518 displays a pay table to the participant. Pressing button 1520 allows the user to identify the number of paylines selected, and button 1522 allows the user to indicate what the bet is per line. Pressing button 1524 spins the reels, and pressing button 1526 automatically wagers the maximum bet. Other user input mechanisms, such as touch screens, audio command input, joysticks, text entry, etc. can be used to identify user input parameters. Another type of input (not shown) for a participant to enter is to identify which one or more symbols are to be played in the mode where a predetermined number of adjacent symbols results in a winning dynamically-generated payline.

Returning now to FIG. 14, the display device 1404 includes a display screen 1410. The display device may take on a variety of forms depending on what type of presentation is to be provided. For example, a slot game area 1420 is provided where the slot gaming activity in accordance with the invention is displayed. In this example, the slot gaming activity provides a 5×3 display segment grid, where each display segment includes four display subsegments. Any number of paylines may be associated with the grid in game area 1420. In this example, the display screen is a video display screen. The video display screen may be implemented in a variety of manners, including electronically represented with outputs shown on conventional electronic displays, such as a liquid crystal displays (LCD), dot matrix, plasma, CRT, LED, electro-luminescent display, or generally any type of video display known in the art.

Also associated with the display device 1404 is an optional winning guide area 1412, where information associated with the potential winning symbol combinations of the standard slot game activity may be presented. This area may also provide an indication of the requisite symbols, symbol combinations, symbol locations, etc. that result in winning payouts to the participant. This information may be part of the display screen 1410, or alternatively may be separate from the display screen 1410 and provided directly on a portion of the display device 1404 structure itself. For example, a backlit colored panel may be used as the winning guide area 1412. Further, this information may be provided on an entirely separate display screen (not shown).

It should be recognized that various manners of displaying the various paylines and payline results may be used in connection with the invention. For example, the paylines can be visualized by the participant for embodiments such as those shown in FIG. 3. Other embodiments include highlighting particular display subsegments to indicate which of the display subsegments is currently viewed as the display segment. Other visual cues may also be used, such as lines drawn through the various paylines, highlighted borders or backlighting, etc., and the invention is not limited to any particular manner of presenting paylines.

Figures 16A, 16B, 16C, 16D, 16E:
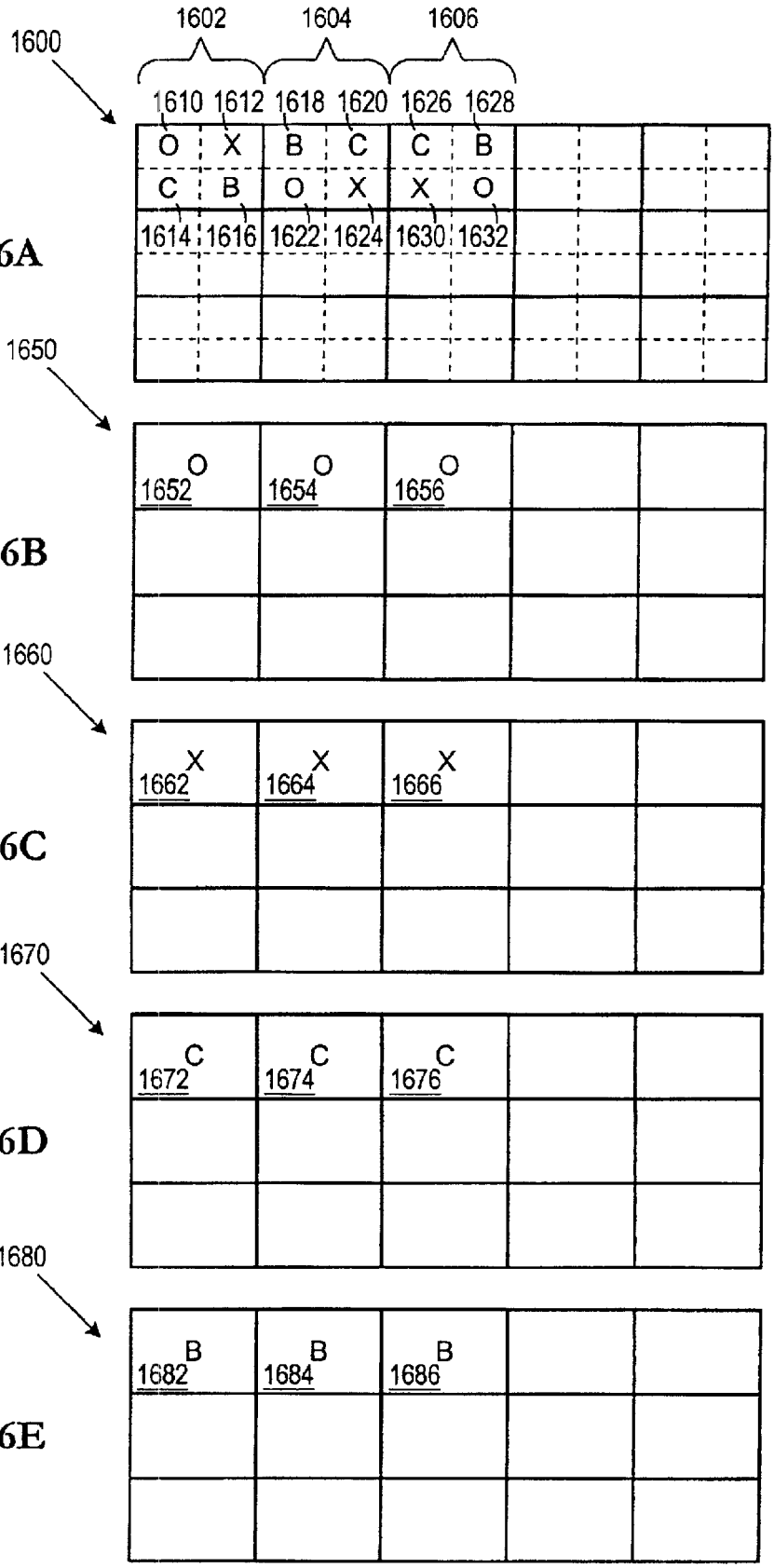
FIGS. 16A, 16B, 16C, 16D, and 16E, illustrates the individual presentation of each winning payline resulting from the multi-symbol display segments in accordance with one embodiment of the invention.

One particular embodiment includes individually presenting each winning payline resulting from the multi-symbol display segments. An example of such an embodiment is shown in FIG. 16, which includes FIGS. 16A, 16B, 16C, 16D, and 16E. The display grid 1600 shown in FIG. 16A represents a multi-symbol display grid as previously described. In this embodiment, there are four display subsegments for each display segment. More particularly, display segment 1602 includes display subsegments 1610, 1612, 1614, and 1616. Similarly, display segment 1604 includes display subsegments 1618, 1620, 1622, and 1624, and display segment 1606 includes display subsegments 1626, 1628, 1630, and 1632. Assuming that three consecutive display segments each have a particular symbol which provides a winning symbol combination. For example, as shown in FIG. 16A, display subsegments 1610, 1622, and 1632 each present a symbol "O" in display segments 1602, 1604, 1606 respectively. In this example, this is a winning symbol combination, as three consecutive display segments include a display subsegment having the symbol "O." In accordance with one embodiment of the invention, this winning symbol combination is presented as an individual payline of three "O" symbols, as shown in FIG. 16B. The display grid 1600 of FIG. 16A is converted to the display grid 1650 of FIG. 16B, or alternatively the display grid 1650 can be shown on an entirely separate display screen. As seen on display grid 1650 of FIG. 16B, the winning symbol combination of "O" symbols is displayed as display segments 1652, 1654, 1656 shown in FIG. 16B. Other winning symbol combinations are similarly shown. For example, the display grid 1660 shown in FIG. 16C shows the winning combination of "X" symbols in display segments 1662, 1664, and 1666, which results from the original spin result shown in display subsegments 1612, 1624, and 1630 of display grid 1600. Similarly, the display grid 1670 shown in FIG. 16D shows the winning combination of "C" symbols in display segments 1672, 1674, and 1676, which results from the original spin result shown in display subsegments 1614, 1620, and 1626 of display grid 1600. Finally, the display grid 1680 shown in FIG. 16E shows the winning combination of "B" symbols in display segments 1682, 1684, and 1686, which results from the original spin result shown in display subsegments 1616, 1618, and 1628 of display grid 1600. Each of the display grids 1650, 1660, 1670, 1680 can be displayed in a variety of manners, such as stepping through each of these display grids 1650, 1660, 1670, 1680 such that each winning payline is temporarily shown. Alternatively, each of the display grids 1650, 1660, 1670, 1680 can be successively displayed in response to user input to change from one display grid to the next. Alternatively, each of the display grids 1650, 1660, 1670, 1680 can be shown in separate display screens. The examples shown in FIGS. 16A, 16B, 16C, 16D, and 16E represent examples of manners in which various winning symbol combinations in accordance with the multi-symbol display segments of the present invention may be presented, however the invention is not limited thereto.

Figure 17:
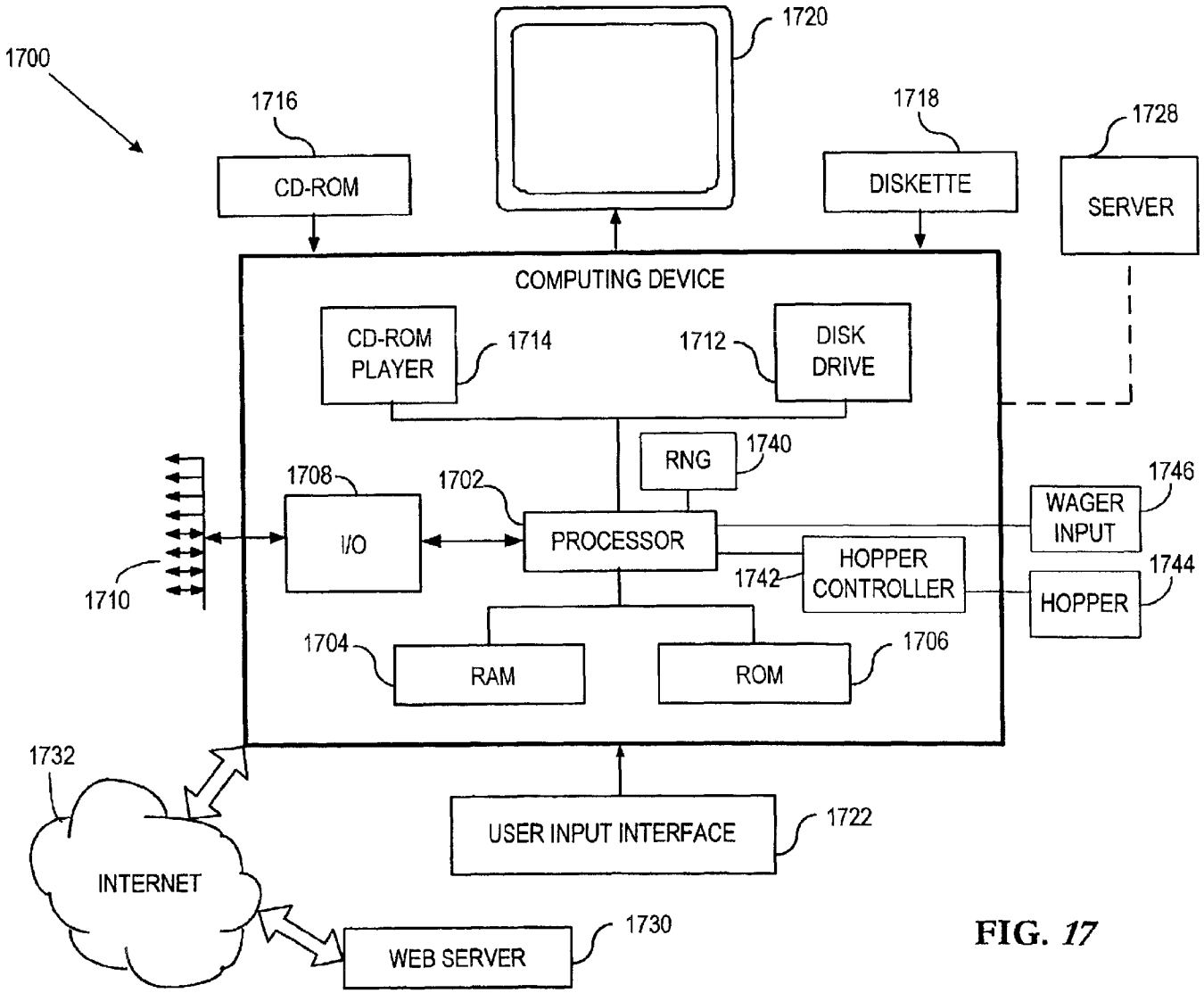
FIG. 17 illustrates a representative computing system capable of carrying out operations in accordance with the invention.

The gaming machines described in connection with the present invention may be independent casino gaming machines, such as slot machines or other special purpose gaming kiosks, video games, or may be computing systems operating under the direction of local gaming software and/or remotely-provided software such as provided by an application service provider (ASP). The casino gaming machines utilize computing systems to control and manage the gaming activity. An example of a representative computing system capable of carrying out operations in accordance with the invention is illustrated in FIG. 17.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 1700 of FIG. 17 is an example computing structure that can be used in connection with such electronic gaming machines, computers, or other computer-implemented devices to carry out operations of the present invention.

The example computing arrangement 1700 suitable for performing the gaming activity utilizing multi-symbol display segments and dynamically-generated paylines in accordance with the present invention typically includes a central processor (CPU) 1702 coupled to random access memory (RAM) 1704 and some variation of read-only memory (ROM) 1706. The ROM 1706 may also be other types of storage media to store programs, such as programmable ROM (PROM), erasable PROM (EPROM), etc. The processor 1702 may communicate with other internal and external components through input/output (I/O) circuitry 1708 and bussing 1710, to provide control signals, communication signals, and the like.

Chance-based gaming systems such as slot machines, in which the present invention is applicable, are governed by random numbers and processors. Electronic reels are used to display the result of the digital reels which are actually stored in computer memory and "spun" by a random number generator (RNG). RNGs are well-known in the art, and may be implemented using hardware, software operable in connection with the processor 1702, or some combination of hardware and software. In accordance with generally known technology in the field of slot machines, the processor 1702 associated with the slot machine, under appropriate program instruction, can simulate the vertical rotation of multiple reels. Generally, the-RNG continuously cycles through numbers, even when the machine is not being played. The slot machine selects, for example, three random numbers. The numbers chosen at the moment the play is initiated are typically the numbers used to determine the final outcome, i.e., the outcome is settled the moment the reels are spun. The resulting random numbers are generally divided by a fixed number. This fixed number is often thirty-two, but for slot machines with large progressive jackpots it may be even greater. After dividing, the remainders will be retained. For example, if the divisor was one-hundred twenty-eight, the machine would have three remainders ranging from zero to one-hundred twenty-seven. The remainders may be considered as stops on virtual reels. If the divisor was one-hundred twenty-eight, then the virtual reels would each have one-hundred twenty-eight stops with each stop being equally likely. Each stop on the virtual reel may be mapped to a stop on an actual reel or displayed reel image. These reel images may then be displayed on the display 1720. The present invention is operable using any known RNG, and may be integrally programmed as part of the processor 1702 operation, or alternatively may be a separate RNG controller 1740. RNGs are well known in the art, and any type of RNG may be implemented for the standard mode of play and/or the bonus mode of play in accordance with the invention.

The computing arrangement 1700 may also include one or more data storage devices, including hard and floppy disk drives 1712, CD-ROM drives 1714, and other hardware capable of reading and/or storing information such as DVD, etc. In one embodiment, software for carrying out the gaming operations in accordance with the present invention may be stored and distributed on a CD-ROM 1716, diskette 1718 or other form of media capable of portably storing information. These storage media may be inserted into, and read by, devices such as the CD-ROM drive 1714, the disk drive 1712, etc. The software may also be transmitted to the computing arrangement 1700 via data signals, such as being downloaded electronically via a network, such as the Internet. Further, as previously described, the software for carrying out the functions associated with the present invention may alternatively be stored in internal memory/storage of the computing device 1700, such as in the ROM 1706. The computing arrangement 1700 is coupled to the display 1720, which represents a display on which the gaming activities in accordance with the invention are presented. The display 1720 merely represents the "presentation" of the video information in accordance with the invention, and may be any type of known display or presentation screen, such as LCD displays, plasma display, cathode ray tubes (CRT), etc.

Where the computing device 1700 represents a stand-alone or networked computer, the display 1720 may represent a standard computer terminal or display capable of displaying multiple windows, frames, etc. Where the computing device is embedded within an electronic gaming machine, such as slot machine 1400 of FIG. 14, the display 1720 corresponds to the display screen 1410 of FIG. 14. A user input interface 1722 such as a mouse or keyboard may be provided where the computing device 1700 is associated with a standard computer. An embodiment of a user input interface 1722 is illustrated in connection with an electronic gaming machine 1400 of FIG. 14 as the various "buttons" 1408. Other user input interface devices include a keyboard, a mouse, a microphone, a touch pad, a touch screen, voice-recognition system, etc.

The computing arrangement 1700 may be connected to other computing devices or gaming machines, such as via a network. The computing arrangement 1700 may be connected to a network server 1728 in an intranet or local network configuration. The computer may further be part of a larger network configuration as in a global area network (GAN) such as the Internet. In such a case, the computer accesses one or more web servers 1730 via the Internet 1732.

Other components directed to slot machine implementations include manners of gaming participant payment, and gaming machine payout. For example, a slot machine including the computing arrangement 1700 may also include a hopper controller 1742 to determine the amount of payout to be provided to the participant. The hopper controller may be integrally implemented with the processor 1702, or alternatively as a separate hopper controller 1742. A hopper 1744 may also be provided in slot machine embodiments, where the hopper serves as the mechanism holding the coins/tokens of the machine. The wager input module 1746 represents any mechanism for accepting coins, tokens, coupons, bills, credit cards, smart cards, membership cards, etc. for which a participant inputs a wager amount.

Using the foregoing specification, the invention may be implemented as a machine, process, or article of manufacture by using standard programming and/or engineering techniques to produce programming software, firmware, hardware or any combination thereof.

Any resulting program(s), having computer-readable program code, may be embodied within one or more computer-usable media such as memory devices or transmitting devices, thereby making a computer program product or article of manufacture according to the invention. As such, the terms "article of manufacture" and "computer program product" as used herein are intended to encompass a computer program existent (permanently, temporarily, or transitorily) on any computer-usable medium such as on any memory device or in any transmitting device.

One skilled in the art of computer science from the description provided herein will be able to combine the software created as described with appropriate general purpose or special purpose computer hardware to create a computer system and/or computer subcomponents embodying the invention, and to create a computer system and/or computer subcomponents for carrying out methods of the invention.

The foregoing description of the exemplary embodiment of the invention has been presented for the purposes of illustration and description. It is not intended to be exhaustive or to limit the invention to the precise form disclosed. Many modifications and variations are possible in light of the above teaching. For example, the present invention is not limited to what is traditionally known as "slot machines." Also, while the illustrated embodiments have been described in large part in connection with a "slot machine," other gaming systems and concepts are also within the scope of the invention, such as video poker games, card games, lotteries, and other casino events implementing a video screen. For example, a video poker game may utilize the present invention to provide multiple cards at each standard card display segment. It is thus intended that the scope of the invention be limited not with this detailed description, but rather by the claims appended hereto.

What is claimed is:

1. A method for facilitating participation in a slot game, comprising:

presenting a display grid comprising a plurality of display segments;

presenting a plurality of display subsegments in at least one of the display segments, wherein each of the display subsegments presents a subsegment symbol independently of the other display subsegments in its respective display segment; and creating paylines from a plurality of the display segments, wherein each of the subsegment symbols of each of the display subsegments is independently used in formulating payout results for each of the paylines in which the display segment is affiliated.

2. The method as in claim 1, wherein creating paylines comprises creating paylines from the plurality of the display segments at predetermined locations, wherein a plurality of the payout results are formulated for each of the paylines associated with at least one display segment having a plurality of the display subsegments.

3. The method as in claim 1, wherein creating paylines comprises dynamically generating the paylines as a result of corresponding symbols occurring in a predetermined number of adjacent display segments.

4. The method as in claim 3, wherein dynamically generating the paylines comprises determining whether each of the adjacent display segments includes the corresponding symbol in either the display segment or in one of the display subsegments of the display segment.

5. The method as in claim 3, wherein the corresponding symbols comprise a predetermined one or more associated symbols.

6. The method as in claim 3, wherein the corresponding symbols comprise matching symbols.

7. The method as in claim 1, further comprising dynamically creating auxiliary paylines having no predetermined arrangement, formulated from corresponding symbols occurring in a predetermined number of adjacent display subsegments independent of the display segments.

8. The method as in claim 1, wherein presenting the display grid comprises displaying a two-dimensional display grid, and wherein presenting a plurality of display subsegments comprises displaying the plurality of display subsegments on two-dimensional displays of their respective display segments.

9. The method as in claim 1, wherein presenting the display grid comprises displaying a three-dimensional display grid, and wherein presenting a plurality of display subsegments comprises displaying the plurality of display subsegments on three-dimensional displays of their respective display segments.

10. The method as in claim 9, wherein displaying the plurality of display subsegments on three-dimensional displays of their respective display segments comprises displaying the plurality of display subsegments on different faces of individual display segment cubes of the three-dimensional display grid.

11. The method as in claim 10, wherein creating paylines comprises creating the paylines along any predetermined path on a face or through the three-dimensional display grid.

12. The method as in claim 10, wherein creating paylines comprises creating the paylines along any dynamically generated payline resulting from corresponding symbols occurring in a predetermined number of adjacent display segments in the three-dimensional display grid.

13. The method as in claim 9, wherein displaying the plurality of display subsegments on three-dimensional displays of their respective display segments comprises displaying the plurality of display subsegments at corresponding locations on different axis of the three-dimensional display grid.

14. The method as in claim 9, wherein displaying the plurality of display subsegments on three-dimensional displays of their respective display segments comprises displaying the plurality of display subsegments on corresponding faces of each of a plurality display subsegment cubes associated with their respective display segments.

15. The method as in claim 1, wherein presenting a plurality of display subsegments comprises presenting the plurality of display subsegments in all of the display segments of the display grid.

16. The method as in claim 1, wherein:

presenting a plurality of display subsegments comprises presenting the plurality of display subsegments in a plurality of the display segments of the display grid; and presenting a display grid comprises presenting a remaining plurality of the display segments with a single symbol.

17. The method as in claim 16, wherein presenting a remaining plurality of the display segments with a single symbol comprises presenting the single symbol independently of symbols and subsegment symbols presented in the other display segments and display subsegments in the display grid.

18. The method as in claim 16, further comprising utilizing the single symbols associated with each of the remaining plurality of the display segments only once in formulating the payout results for each of the paylines in which the display segment is affiliated.

19. The method as in claim 16, further comprising utilizing the single symbols associated with each of the remaining plurality of the display segments repeatedly in formulating the payout results for each of the paylines in which the display segment is affiliated.

20. The method as in claim 19, wherein utilizing the single symbols repeatedly comprises repeatedly utilizing the single symbols for each of the payout results that can be formulated for a particular payline using each of the display subsegments in other display segments of the particular payline.

21. The method as in claim 1, further comprising formulating the payout results for each of the paylines using each of the subsegment symbols only once.

22. The method as in claim 1, further comprising formulating the payout results for each of the paylines allowing at least one of the subsegment symbols associated with a respective display subsegment a predetermined number of times in formulating the payout results.

23. The method as in claim 1, further comprising presenting payout results on the display grid by distinguishing the symbols and subsegment symbols associated with a winning payout result from the other symbols and subsegment symbols.

24. The method as in claim 1, further comprising presenting payout results on individual display grids each revealing the subsegment symbols associated with a winning payout result in their respective display segments without displaying other subsegment symbols associated with the respective display segment.

25. The method as in claim 24, wherein the revealed subsegment symbols associated with the winning payout result are displayed in an increased size in their respective display segments.

26. The method as in claim 1, wherein presenting a plurality of display subsegments and creating paylines from a plurality of the display segments is effected in a standard mode of the slot game.

27. The method as in claim 1, wherein presenting a plurality of display subsegments and creating paylines from a plurality of the display segments is effected in a bonus mode of the slot game.

28. The method as in claim 1, wherein presenting a display grid comprises presenting a display grid via a video display.

29. The method as in claim 1, wherein presenting a display grid comprises presenting a display grid via a mechanical reel display.

30. A method for facilitating participation in a slot game, comprising:

presenting a display grid comprising a plurality of display segments;

dynamically creating winning slot game paylines formulated from corresponding symbols occurring in a predetermined number of adjacent display segments.

31. The method of claim 30, further comprising:

providing at least a first mode of slot game play and a second mode of slot game play;

presenting a plurality of display subsegments in at least one of the display segments in the first mode of slot game play, wherein each of the display subsegments presents a subsegment symbol independently of the other display subsegments in its respective display segment;

in the first mode of slot game play, creating paylines from a plurality of the display segments, wherein each of the subsegment symbols of each of the display subsegments is independently used in formulating payout results for each of the paylines in which the display segment is affiliated; and dynamically creating the winning slot game paylines formulated from corresponding ones of either or both of the symbols and subsegment symbols occurring in a predetermined number of adjacent display segments when in the second mode of slot game play.

32. The method of claim 31, wherein the first mode of slot game play is a standard mode and the second mode of slot game play is a bonus mode availed in response to an occurrence of a predetermined symbol combination in the standard mode of slot game play.

33. The method of claim 30, wherein presenting a display grid comprising a plurality of display segments and dynamically creating winning slot game paylines is availed during a standard mode of slot game play.

34. The method of claim 30, wherein presenting a display grid comprising a plurality of display segments and dynamically creating winning slot game paylines is availed during a bonus mode of slot game play.

35. The method of claim 30, further comprising configuring the predetermined number of adjacent display segments by assigning a minimum number of adjacent corresponding symbols required to create the winning slot game paylines for particular symbols of the slot game.

36. The method of claim 35, wherein at least one of the symbols of the slot game results in no winning slot game payline regardless of the number of adjacent corresponding symbols that occur.

37. The method of claim 35, wherein an occurrence of the predetermined number of adjacent display segments results in a first payout result.

38. The method of claim 37, wherein an occurrence of a number of the adjacent display segments greater than the predetermined number results in a second payout result greater than the first payout result.

39. The method of claim 37, wherein an occurrence of a number of the adjacent display segments greater than the predetermined number results in a second payout result larger than the first payout result, wherein the second payout result is based on a multiplier and a difference between the number of adjacent display segments greater than the predetermined number.

40. The method of claim 30, further comprising allowing participant selection of one or more symbols desired by the participant to be used in dynamically creating the winning slot game paylines.

41. The method of claim 40, further comprising requiring additional wager inputs by the participant for additional symbols desired by the participant to be used in dynamically creating the winning slot game paylines.

42. The method of claim 30, further comprising predefining one or more symbols to be used in dynamically creating the winning slot game paylines.

43. A casino gaming apparatus hosting a gaming activity, the casino gaming apparatus comprising:

a display device to present a display grid having a plurality of display segments, and to present a plurality of display subsegments in each of one or more of the display segments;

a random number generator configured to randomly select symbols for presentation in the display segments and the display subsegments of the display grid; and a processor configured to identify winning symbol combinations presented on display segment paylines of the display grid, wherein the winning symbol combinations comprise corresponding symbols in each of the display segments of the display segment paylines, and wherein each of the symbols presented in the display subsegments of a display segment is independently considered in identifying the winning symbol combinations occurring on the display segment paylines encompassing that display segment.

44. The casino gaming apparatus as in claim 43, wherein the display segment paylines have predetermined locations in the display grid.

45. The casino gaming apparatus as in claim 43, wherein the processor is further configured to identify second winning symbol combinations presented on dynamically-generated paylines, wherein the dynamically-generated paylines are identified by determining an occurrence of a predetermined number of adjacent display segments presenting the corresponding symbols.

46. The casino gaming apparatus as in claim 43, wherein the processor is further configured to identify winning symbol combinations presented on dynamically-generated paylines, wherein the dynamically-generated paylines are identified by determining an occurrence of a predetermined number of adjacent display subsegments presenting the corresponding symbols across display segment boundaries.

47. The casino gaming apparatus as in claim 43, wherein the processor is further configured to identify winning symbol combinations presented on dynamically-generated paylines, wherein the dynamically-generated paylines are identified by determining an occurrence of a predetermined number of adjacent display segments and display subsegments presenting the corresponding symbols.

48. The casino gaming apparatus as in claim 43, wherein the random number generator is integral with the processor.

49. The casino gaming apparatus as in claim 43, further comprising a reel strip associated with each of the display segments and display subsegments from which the symbols for each respective display segment and subsegment is selected.

50. The casino gaming apparatus as in claim 49, wherein the reel strips are physical strips, and wherein the random number generator randomly selects a reel strip stop position to select the symbol for presentation in the display segments and display subsegments of the display grid.

51. The casino gaming apparatus as in claim 49, further comprising a memory to store each of the reel strips as electronic reel strips, and wherein the random number generator randomly selects one of the symbols associated with each electronic reel strip for presentation in the display segments and display subsegments of the display grid.

52. The casino gaming apparatus as in claim 43, wherein the casino gaming apparatus is a slot machine.

53. The casino gaming apparatus as in claim 43, wherein the casino gaming apparatus is a video poker machine.

54. A slot machine comprising:

a display to present a display grid having a plurality of display segments;

a random number generator configured to randomly select symbols for presentation in the display segments; and a processor configured to identify at least one dynamically-generated winning symbol combination by recognizing a predetermined minimum number of adjacent display segments presenting corresponding symbols therein.

55. The slot machine of claim 54, wherein the display presents a two-dimensional display grid, and wherein the processor is configured to identify at least one dynamically-generated winning symbol combination by recognizing a predetermined minimum number of any touching display segments on the two-dimensional display grid.

56. The slot machine of claim 54, wherein the display presents a three-dimensional display grid, and wherein the processor is configured to identify at least one dynamically-generated winning symbol combination by recognizing a predetermined minimum number of any touching display segments on the three-dimensional display grid.

57. The slot machine of claim 54, further comprising a user interface to allow a participant to select the symbols to be identified as the dynamically-generated winning symbol combination.

58. A computer-readable medium having computer-executable instructions for facilitating slot gaming activity using multiple symbols per display segment, the computer-executable instructions performing steps comprising:

presenting a display grid comprising a plurality of display segments;

presenting a plurality of display subsegments in at least one of the display segments, wherein each of the display subsegments presents a subsegment symbol independently of the other display subsegments in its respective display segment; and creating paylines from a plurality of the display segments, wherein each of the subsegment symbols of each of the display subsegments is independently used in formulating payout results for each of the paylines in which the display segment is affiliated.

59. A computer-readable medium having computer-executable instructions for facilitating dynamic paylines in slot gaming activity, the computer-executable instructions performing steps comprising:

presenting a display grid comprising a plurality of display segments;

dynamically creating winning slot game paylines formulated from corresponding symbols occurring in a predetermined number of adjacent display segments.

60. A slot machine comprising:

means for presenting a display grid comprising a plurality of display segments;

means for presenting a plurality of display subsegments in at least one of the display segments, wherein each of the display subsegments presents a subsegment symbol independently of the other display subsegments in its respective display segment; and means for creating paylines from a plurality of the display segments, wherein each of the subsegment symbols of each of the display subsegments is independently used in formulating payout results for each of the paylines in which the display segment is affiliated.

61. A slot machine comprising:

means for presenting a display grid comprising a plurality of display segments;

means for dynamically creating winning slot game paylines formulated from corresponding symbols occurring in a predetermined number of adjacent display segments.

* * * * *

UNITED STATES PATENT AND TRADEMARK OFFICE

CERTIFICATE OF CORRECTION

PATENT NO. : 6,896,615 B2
DATED : May 24, 2005
INVENTOR(S) : Berman

It is certified that error appears in the above-identified patent and that said Letters Patent is hereby corrected as shown below:

Title page,
Item [57], ABSTRACT,
Line 2, "A display grid having a multiple" should read
-- A display grid having multiple --.

Column 3,
Line 11, "A random number generator randomly select" should read
-- A random number generator randomly selects --.

Column 4,
Line 44, "which provides" should read -- which provide --.

Column 16,
Lines 61-62, "at display segments 1300, 1302, and 1304." should read
-- at display segments 1302, 1304, and 1306. --.
Lines 63-64, "at display segments 1306, 1308, 1310, and 1312." should read
-- at display segments 1308, 1310, 1312, and 1314. --.

Signed and Sealed this

Third Day of January, 2006

JON W. DUDAS
*Director of the United States Patent and Trademark Office*